US007973463B2

(12) United States Patent
Murakami

(10) Patent No.: US 7,973,463 B2
(45) Date of Patent: Jul. 5, 2011

(54) ELECTRON-EMITTING DEVICE, ELECTRON SOURCE, IMAGE DISPLAY APPARATUS AND METHOD OF FABRICATING ELECTRON-EMITTING DEVICE

(75) Inventor: Shunsuke Murakami, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 438 days.

(21) Appl. No.: 11/697,914

(22) Filed: Apr. 9, 2007

(65) Prior Publication Data

US 2007/0257593 A1 Nov. 8, 2007

(30) Foreign Application Priority Data

Apr. 21, 2006 (JP) ..... 2006-117730

(51) Int. Cl.
*H01J 1/62* (2006.01)

(52) U.S. Cl. ..... 313/495; 313/310

(58) Field of Classification Search ..... 313/310, 313/309, 311, 49, 495–497
See application file for complete search history.

(56) References Cited

U.S. PATENT DOCUMENTS

| | | | | |
|---|---|---|---|---|
| 4,940,916 | A * | 7/1990 | Borel et al. | 313/306 |
| 5,473,218 | A | 12/1995 | Moyer | 313/309 |
| 5,557,160 | A * | 9/1996 | Makishima et al. | 313/336 |
| 5,559,389 | A * | 9/1996 | Spindt et al. | 313/310 |
| 5,786,659 | A * | 7/1998 | Takagi et al. | 313/309 |
| 5,932,963 | A * | 8/1999 | Nakamura et al. | 313/495 |
| 6,078,133 | A * | 6/2000 | Menu et al. | 313/310 |
| 6,350,999 | B1 * | 2/2002 | Uenoyama et al. | 257/191 |
| 6,452,328 | B1 * | 9/2002 | Saito et al. | 313/495 |
| 6,794,805 | B1 * | 9/2004 | Hatai et al. | 313/309 |
| 6,917,155 | B1 * | 7/2005 | Kamide et al. | 313/495 |
| 7,109,663 | B2 | 9/2006 | Fujiwara et al. | 315/169.4 |
| 7,259,520 | B2 | 8/2007 | Fujiwara et al. | 315/169.1 |
| 2002/0117960 | A1 * | 8/2002 | Yi et al. | 313/495 |
| 2004/0251812 | A1 | 12/2004 | Fujiwara et al. | 313/495 |
| 2005/0200266 | A1 * | 9/2005 | Nomura | 313/495 |
| 2006/0061289 | A1 | 3/2006 | Fujiwara et al. | 315/169.1 |
| 2006/0066199 | A1 * | 3/2006 | Ichikawa et al. | 313/311 |
| 2007/0029917 | A1 * | 2/2007 | Hong et al. | 313/495 |
| 2007/0188068 | A1 | 8/2007 | Murakami | 313/310 |
| 2008/0116783 | A1 * | 5/2008 | Kim et al. | 313/498 |

FOREIGN PATENT DOCUMENTS

| | | |
|---|---|---|
| CN | 1109205 | 9/1995 |
| CN | 1659671 | 8/2005 |
| JP | 8-55564 | 2/1996 |
| JP | 2001-250469 | 9/2001 |
| JP | 2002-352699 | 12/2002 |
| JP | 2004-71536 | 3/2004 |
| JP | 2005-26209 | 1/2005 |

OTHER PUBLICATIONS

Chinese Official Letter dated Jun. 19, 2009, regarding Application No. 2007101008617.

* cited by examiner

*Primary Examiner* — Nimeshkumar D Patel
*Assistant Examiner* — Mary Ellen Bowman
(74) *Attorney, Agent, or Firm* — Fitzpatrick, Cella, Harper & Scinto

(57) ABSTRACT

There are provided a stable electron-emitting device with less fluctuation in electron-emitting properties and a method of fabricating the electron-emitting device. The electron-emitting device has a substrate; a plurality of columnar first regions respectively orientated substantially perpendicular to the surface of the substrate; a second region provided between the respective first regions higher than the first regions in resistance; and an electron emission layer covering the columnar first regions and the second region.

10 Claims, 15 Drawing Sheets

ELECTRON-EMITTING DEVICE, ELECTRON SOURCE, IMAGE DISPLAY APPARATUS AND METHOD OF FABRICATING ELECTRON-EMITTING DEVICE

BACKGROUND OF THE INVENTION

1. Field of the Invention

The present invention relates to an electron-emitting device, an electron source including the electron-emitting devices and an image display apparatus including the electron source.

2. Description of the Related Art

The electron-emitting device includes an electron-emitting device of a field-emission type (hereinafter to be referred to as "FE type") and an electron-emitting device of a surface conduction type.

As an electron-emitting device of the FE type, an electron-emitting device having an electron beam with less spread is exemplified by an electron-emitting device comprising a gate electrode provided with openings (so-called "gate halls") on flat electron-emitting film as in Japanese Patent Application Laid-Open No. 2004-071536, Japanese Patent Application Laid-Open No. H08-055564 and Japanese Patent Application Laid-Open No. 2005-26209. In the electron-emitting device including such a flat electron emission layer, a comparatively flat equipotential surface is formed on the electron emission layer. Therefore spread of electron beams can be made small.

On the other hand, the image display apparatus with an electron-emitting device has to carry out stable electron emission in order to secure luminance uniformity and reliability. Specifically, the electron-emitting device has to be prevented from being destroyed by overcurrent and the like during an operation. Moreover, the electron emission amount has to be prevented from varying over time, that is, fluctuation in the electron emission amount has to be made less. As measures thereof, Japanese Patent Application Laid-Open No. 2002-352699 discloses an electron-emitting device with a plurality of split electrodes. Japanese Patent Application Laid-Open No. 2001-250469 discloses an electron-emitting device with porous alumina including microspace to be filled with resistance material and moreover filled with electron-emitting material such as fine particles with fixing material.

SUMMARY OF THE INVENTION

In the case of producing an electron-emitting device (FE type electron-emitting device) having the above described flat electron emission layer, it is necessary to provide an insulating layer having a communication opening and a gate electrode on the electron emission layer. Such an electron-emitting device is arranged on a substrate.

However, depending on material and thickness of respective members configuring the electron-emitting device, intensive stress is occasionally generated. Moreover, the electron-emitting device is occasionally delaminated or the electron emission layer is delaminated from the substrate. That tendency is remarkable in particular in the case of film including carbon as main ingredient with good electron-emitting properties represented by film mainly comprising diamond-like carbon and film mainly comprising amorphous carbon.

In addition, stacking a resistance layer for limiting current in order to reduce fluctuation in electron emission amount in the electron-emitting device comprising a flat electron emission layer, the electron emission layer is occasionally delaminated from the substrate due to the above described reasons.

In addition, in the case of the electron emission layer containing metal as disclosed in Japanese Patent Application Laid-Open No. 2004-071536, it is important to control the metal amount in the electron emission layer. However, when the metal in the electron emission layer moves to an electrode (for example, cathode electrode) contacting the electron emission layer, the metal amount and the like in the electron emission layer occasionally varies to change the electron-emitting properties. Therefore, it is necessary to provide a layer for preventing metal in the electron emission layer from moving to a member such as a cathode electrode in contact with the electron emission layer. On the other hand, it is necessary to prevent the electron emission layer from being delaminated as described above.

Therefore, an object of the present invention is to provide an electron-emitting device with less fluctuation in electron emission amount, with an electron emission layer restrained to get delaminated from a substrate and a member (for example, cathode electrode) in contact with the electron emission layer and with less fluctuation in electron-emitting properties and a method of fabricating the electron-emitting device.

In order to attain the above described object, the present invention is accomplished as follows.

That is, the present invention is an electron-emitting device comprising an electroconductive layer and an electron emission layer arranged over the electroconductive layer, characterized in that the electroconductive layer comprises a surface including at least a plurality of first regions and a second region provided between the respective first regions higher than the first regions in resistance and the electron emission layer covers the surface of the electroconductive layer.

In addition, the present invention is characterized by comprising (A) a substrate; (B) a plurality of columnar first regions respectively orientated substantially perpendicular to the surface of the substrate; (C) a second region provided between the respective first regions higher than the first regions in resistance; and (D) an electron emission layer covering the columnar first regions and the second region.

In addition, the present invention is a method of fabricating an electron-emitting device comprising an electroconductive layer and an electron emission layer arranged over the electroconductive layer characterized by including (i) (a) a process of preparing structure comprising a plurality of electroconductive columnar regions and (b) a layer containing metal arranged over the electroconductive layer and (ii) a process of heating the structure.

According to the present invention, there can be provided an electron-emitting device which is prevented from being delaminated from a substrate and does not require any resistance layer for limiting current to be provided except a cathode electrode and presents less fluctuation in electron emission amount and a method of fabricating the electron-emitting device.

Further features of the present invention will become apparent from the following description of exemplary embodiments with reference to the attached drawings.

DESCRIPTION OF THE EMBODIMENTS

An exemplary embodiment of the present invention will be described in detail below in an exemplary fashion with the drawings. However, sizes, material, shapes, relative positions thereof and the like described in the following embodiment will not be intended to limit the scope of the present invention unless otherwise specified.

Figure 1:
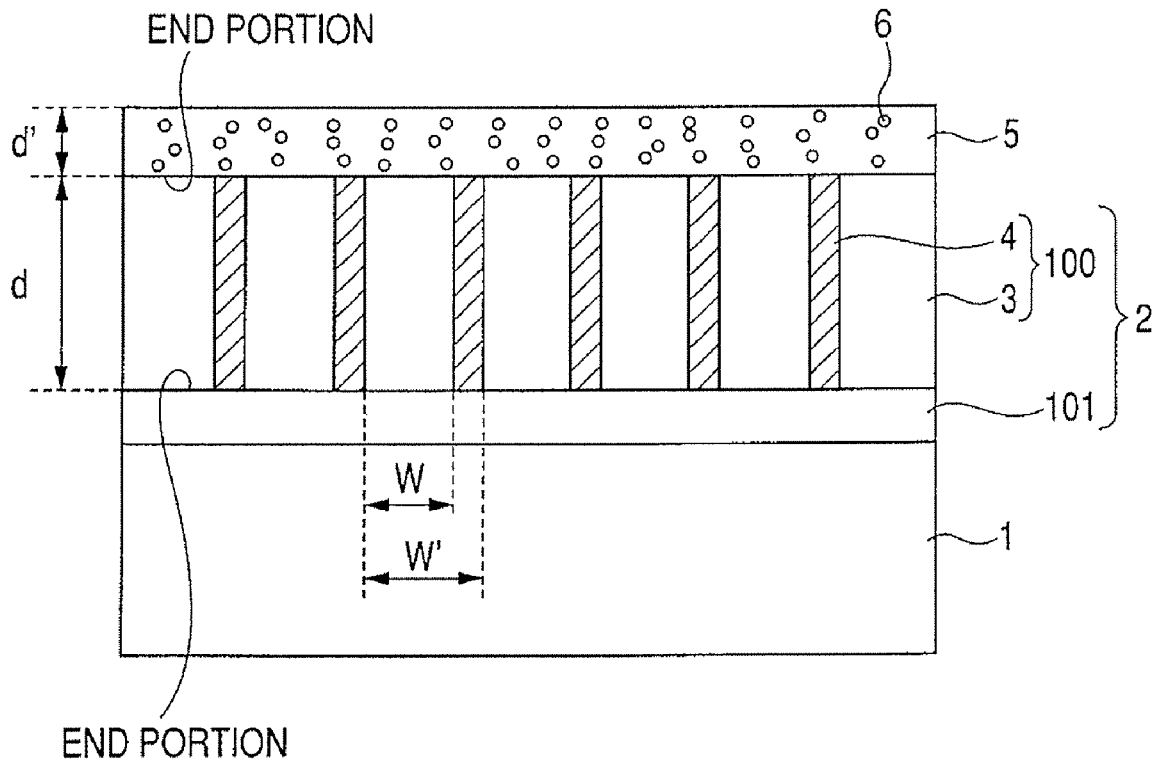
FIG. 1 illustrates schematically a configuration of an electron-emitting device.

FIG. 1 illustrates schematically a section of an example of an electron-emitting device of the present invention. The electron-emitting device of the present invention is arranged over a surface of a substrate 1, comprising at least an electroconductive layer 2 and an electron emission layer 5 located over the electroconductive layer 2. Here, the electroconductive layer 2 is occasionally called "cathode electrode" or "electrode".

In addition, the electroconductive layer 2 includes, at least, a plurality of electroconductive first regions 3 and a region 4 inferior to the first regions 3 in electroconductive property provided between the mutually adjacent first regions 3. The electroconductive layer 2 is provided with end portions of the above described plurality of first regions 3 and an end portion of the second region 4 on its surface. The electron emission layer 5 is mounted over the surface of the electroconductive layer 2. Therefore, it can be said that the mode brings the end portions of the plurality of first regions 3 and the electron emission layer 5 into electric connection. Here, a mode may be provided with any layer between the electroconductive layer 2 and the electron emission layer 5. Nevertheless, that mode will also fall within the scope of the present invention as far as it falls within the range to give rise to effects of the present invention. That is, it can be said that, even if a thin oxide layer, for example, is formed over the surface of the electroconductive layer 2, such a state that the electron emission layer 5 is provided with electrons from the respective first regions 3 will fall within a range to give rise to effects of the present invention. In addition, it can be restated that each of the plurality of first regions 3 is an "electroconductive cell", "electroconductive channel" or "current path" which is substantially electrically separated each other by the region 4.

FIG. 1 shows an the electron-emitting device in the mode with the electroconductive layer 2 further comprising a third region 101 in order to supply the electron emission layer 5 with current from each first region 3 efficiently. In that made, the third region 101 can be configured by material having conductivity superior to the conductivity of the first regions 3 (or the third region 101 is superior to the first regions 3 in resistance). In that mode, a plurality of first regions 3 will be mounted over the third region 101. Therefore, it can be said that the first regions 3 are respectively and commonly brought into electrical connection through the third region 101. In such a mode, since the third region 101 can be formed to shape film, the third region is restated to be an electroconductive film. In such a mode, it can be said that the first regions 3 and the second regions 4 are sandwiched by the electron emission layer 5 and the third region 101. The third region 101 can be typically configured by metal film.

The electron-emitting device of the present invention may be a mode further including a resistor added between the third region 101 and the first regions 3 illustrated in FIG. 1. That mode includes a fourth region (not illustrated in the drawing) as a resistor arranged between the third region 101 and each first region 3. That fourth region is desirably formed into a film shape similar to the third region. Therefore, the fourth region can be called also as resistance film. And in such a mode, each first region 3 will be brought into common connection through the fourth region. It can be said that such a case of mode is a mode with a plurality of first regions 3 and the second region 4 being sandwiched by the electron emission layer 5 and the fourth region. In the case of using the fourth region as a resistance layer, there may be a case where the above described third region 101 is occasionally not required, depending on the resistance value thereof though.

Thus, in the case where the third region 101 is arranged between the first regions 3 and the substrate 1, the power supply to drive the electron-emitting device is connected to the third region 101. Here in the case of using the fourth region together with the third region 101, the power supply for driving the electron-emitting device is connected to the third region 101. However, in the case where the fourth region is arranged between the first regions 3 and the substrate 1 without using the third region 101, the power supply for driving the electron-emitting device can be connected to the fourth region 101.

Figure 10:
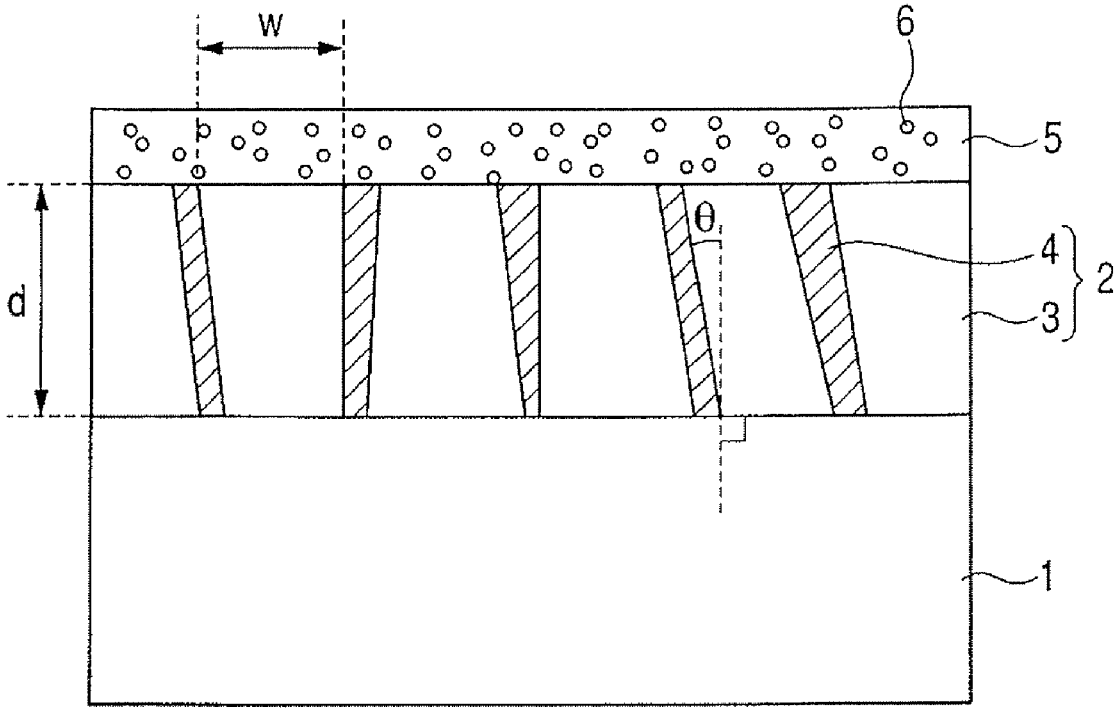
FIG. 10 illustrates schematically a section of an electroconductive layer of an electron-emitting device of the present invention.

Here, the electron-emitting device of the present invention may be a mode not comprising the above described third region 101 (and/or the fourth region) as illustrated in FIG. 10. It can be said that the case of such a mode is a mode with a plurality of first regions 3 and second region 4 being sandwiched by the electron emission layer 5 and the substrate 1.

Here, a mode including the first regions 3 being configured by columnar regions is illustrated. However, the first regions 3 will not be limited to the columnar shape but may be shaped differently such as spherically shaped. However, in order to provide the number of electron emission site densely to reduce fluctuation of the electron emission amount and in order to secure close contact between the electron emission layer 5 and the electroconductive layer 2, the first regions 3 can be shaped columnar.

In the case where the first regions 3 are shaped columnar, the electroconductive layer 2 includes at least a plurality of columnar first regions 3 and regions 4 inferior to the region 3 in electroconductive property. Therefore, a structure 100 with such a plurality of columnar first regions 3 and the second region 4 inferior to the first regions 3 in electroconductive property can be also called as "columnar structure" or "columnar crystal".

Here, a plurality of columnar regions 3 illustrated in FIG. 1 is respectively orientated perpendicular to the surface (flat plane) of the substrate 1. The columnar regions 3 in the present invention can be not only a mode with their longitudinal direction being aligned perpendicular to the surface of the substrate 1 (the surface of the third region 101) as illustrated in FIG. 1 but also a mode with their longitudinal direction being set substantially perpendicular to the surface of the substrate 1 as illustrated in FIG. 10. In that case, the profile line of a columnar region 3 (or the centerline of the columnar region 3) and the line perpendicular to the substrate surface make an angle θ, which the closer it comes to 0°, the more preferable. And from the point of view of uniformity in electron-emitting properties, the practical range can be set to the range of not less than 0° and not more than 30°.

In addition, it can be said that the mode of the electron-emitting device as illustrated in FIG. 1 includes a great number of columnar region 3 with their respective longitudinal directions being aligned substantially in one direction (within the above described practical range), being a mode with an end portion of each of a great number of the columnar regions 3 in their longitudinal direction being covered by an electron emission layer 5. Otherwise, it is comprehensible that each of a great number of columnar regions 3 comprises two mutually opposite end portions in its longitudinal direction and the longitudinal direction is arranged substantially perpendicular to the surface of the substrate 1. Here, it is comprehensible that the above described longitudinal direction to which the profiles of the columnar regions 3 or the centerlines of the columnar regions 3 are drawn.

Here, it can be said that the first regions 3 are shaped in a columnar (i.e., column-like shape) and moreover, in a mode comprising the above described third region, the longitudinal direction of each columnar region 3 is substantially parallel to the direction to which the electron emission layer 5 is disposed in opposition to the third region 101. In addition, in the case where the third region 101 is an electroconductive film, it is comprehensible that each columnar region 3 is orientated substantially perpendicular to the electron emission layer 5 and the electroconductive film being the third region 101.

The columnar region 3 can be stipulated by height (thickness) d and the diameter W of ("length" or "width" in the direction in parallel to the surface of the substrate 1) of the columnar regions 3. The sectional shape (planar shape) at the time of cutting each columnar region 3 with the plane parallel to the surface of the substrate 1 can be a circular shape in view of intensifying the density of the electron-emitting region. However, the sectional shape can be a polygonal shape selected from the group consisting of a triangle, a quadrangle, a pentagonal shape and the like.

The length W' corresponds to single period length (pitch) in the case where the regions 3 (first regions 3) are arranged periodically. It is comprehensible that W'−W is the length of the second region 4. Otherwise, it is comprehensible that W'−W is the shortest distance between the mutually adjacent first regions 3.

There is described such a mode where the first regions 3 are configured by columnar regions. However, the first regions 3 need not be shaped only in a columnar shape, but can be another shape such as a spherical one. Anyway, in the present invention, each of a plurality of first regions 3 can be considered to be substantially "electroconductive cell" or "current path" electrically split each other by the region 4.

Figure 2A:
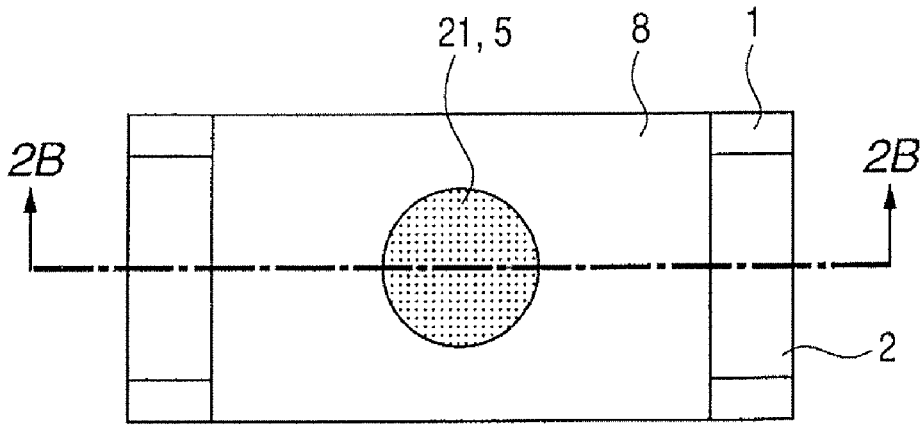
FIGS. 2A and 2B illustrate schematically a configuration of an electron-emitting device.
Figure 2B:
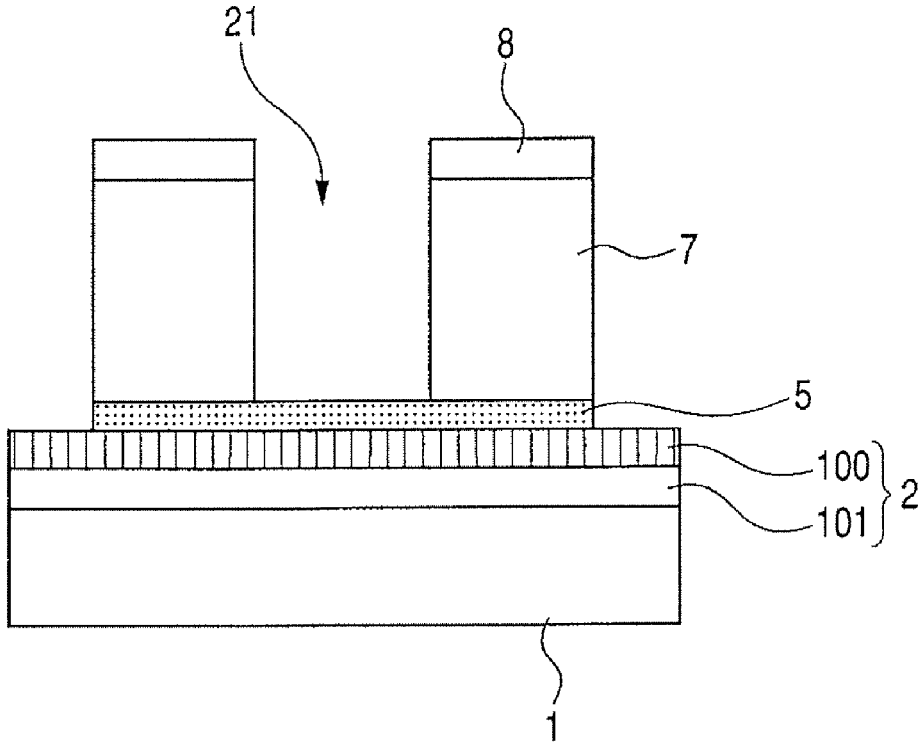

The electron-emitting device of the present invention may be a mode schematically illustrated in FIG. 2A and FIG. 2B. FIG. 2A is a plan view. FIG. 2B is a sectional view along 2B-2B in FIG. 2A. That is, the mode comprises, over the electron emission layer 5 illustrated in FIG. 1, an insulating layer 7 including an opening and a second electrode 8 including an opening. The insulating layer 5 and the second electrode 8 are provided with a communicating (piercing) opening 21. The electron-emitting device of this mode emits electrons from the electron emission layer 5 by applying to the second electrode 8 potential higher than potential of the electroconductive layer 2. Accordingly, the second electrode 8 generates an electric field necessary for causing the electron emission layer 5 to emit an electric field. Therefore, the second electrode 8 corresponds to so-called "extraction electrode" or "gate electrode". The opening 21 is exemplified to be circular here but may be rectangular or polygonal.

Figure 7A:
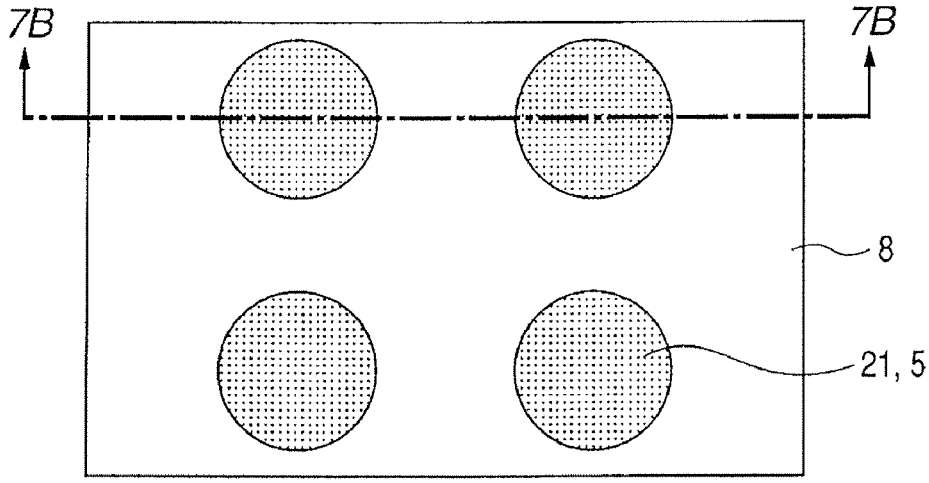
FIGS. 7A, 7B and 7C illustrate schematically an example of an electron-emitting apparatus with an electron-emitting device of the present invention.
Figure 7B:
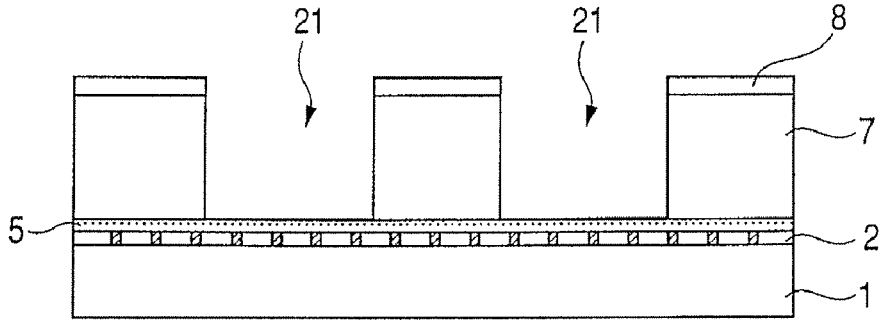
Figure 7C:
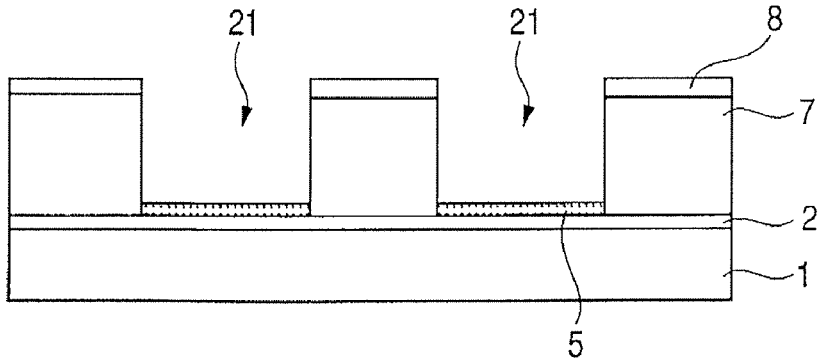

In addition, the electron-emitting device of the present invention can be a mode schematically illustrated in FIG. 7A to 7C. FIG. 7A is a plan view. FIG. 7B is a sectional view along 7B-7B in FIG. 7A. In addition, FIG. 7C is a variation of the section along 7B-7B in FIG. 7A.

The mode illustrated in FIGS. 2A and 2B are mode with an electron-emitting device comprising a single opening 21. However, the electron-emitting device of the present invention can be a mode with an electron-emitting device comprising a plurality of openings 21 as illustrated in FIG. 7A. FIG. 7C illustrates a mode where an electron emission layer 5 is arranged only inside the openings 21. Here, the same symbols in FIGS. 2A and 2B are given for the same members in FIGS. 7A to 7C.

Figure 9:
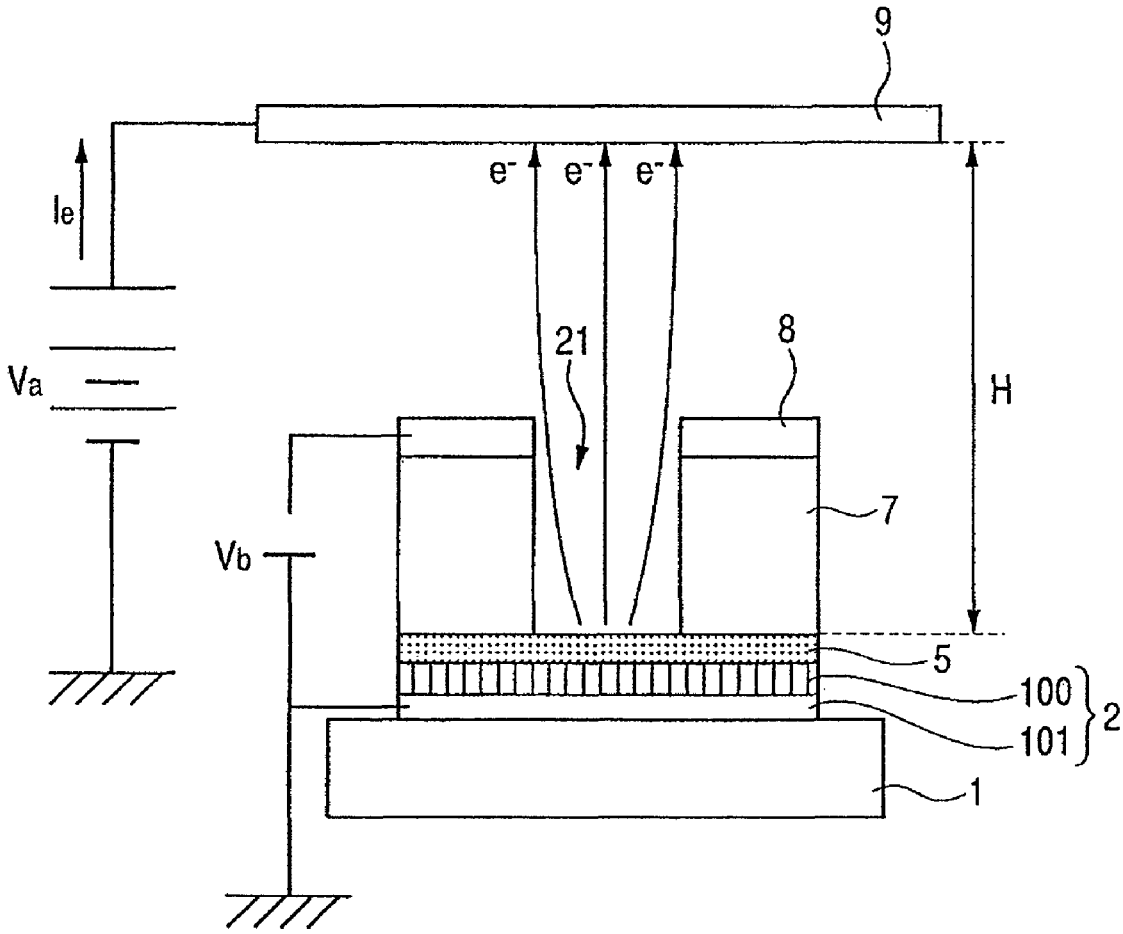
FIG. 9 illustrates schematically an electron-emitting apparatus with an electron-emitting device of the present invention.

An electron-emitting apparatus (including an image display apparatus) with the electron-emitting device of the present invention adopts the triode structure (the electroconductive layer 2, second electrode 8 and anode 9) as illustrated, for example, in FIG. 9. Of course, it is possible to configure an electron-emitting apparatus in the diode structure with an anode 9 arranged so as to be opposite to the electron-emitting device illustrated in FIG. 1 without using the electrode 8.

In FIG. 9, an anode electrode 9 being a third electrode is arranged so as to be substantially parallel to the surface of the substrate 1 where the electron-emitting device of the present invention of a mode illustrated in FIGS. 2A and 2B are arranged. Potential higher than potential of the electron emission layer 5 and the second electrode 8 is applied to the anode electrode 9. At driving, potential higher than potential of the electron emission layer 5 is applied to the second electrode 8. Thereby electrons are emitted from the electron emission layer 5. Typically, potential higher than potential of the third region 101 is applied to the second electrode 8. Potential sufficiently higher than potential of the second electrode 8 is applied to the anode 9. The emitted electrons travel through the opening 21 and are attached to the anode 9 due to potential of the anode electrode 9 to crash into the anode electrode 9.

In the case of adopting the columnar structure as in FIG. 1, for the electroconductive layer 2, the entire stress of the electroconductive layer 2 can be alleviated, enabling the electron emission layer 5 to be hardly delaminated from the substrate 1.

Figure 11A:
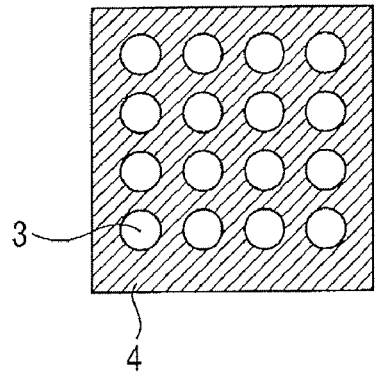
FIGS. 11A, 11B, 11C, and 11D illustrate schematically a plan view of surface of an electroconductive layer of an electron-emitting device of the present invention.
Figure 11B:
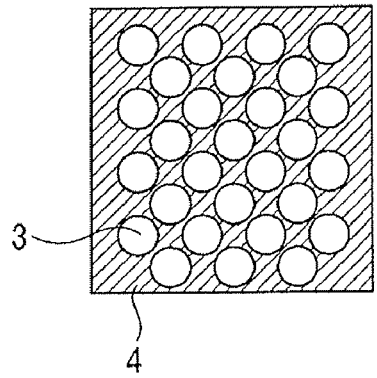
Figure 11C:
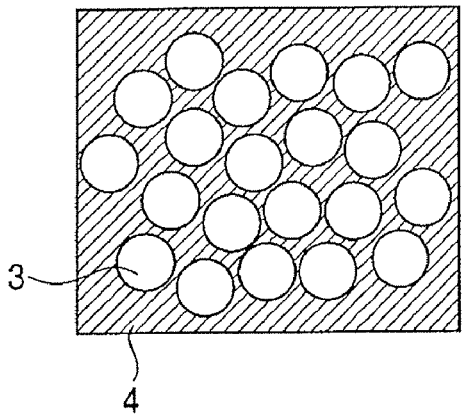
Figure 11D:
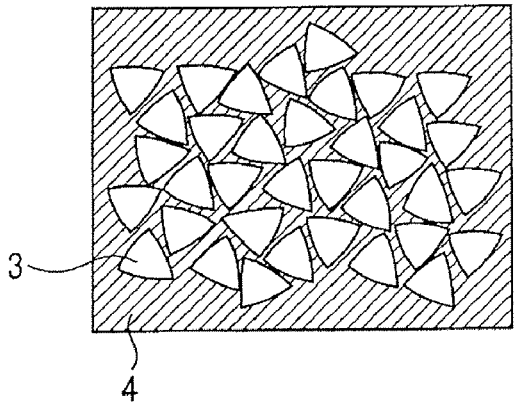

An example of appearance viewed from above the surface of the substrate 1 is illustrated in FIGS. 11A to 11D. FIGS. 11A to 11C illustrate the case where the planar (sectional) shape of each region 3 is circular. FIG. 11D illustrates the case where the planar (sectional) shape of each region 3 is a triangular being an example of the polygonal shape. As for the planar (sectional) shape of each of a plurality of regions 3, the same ones or substantially the same ones can be arranged. Otherwise, various modes may be mixed.

Various modes of arranging a plurality of regions 3 can be adopted. For example, as illustrated in FIG. 11B, a great number of regions 3 can be arranged to shape a honeycomb to make a mode so as to intensify the density of the regions 3 or to shape a matrix to make a mode as illustrated in FIG. 11A. Otherwise, a mode as illustrated in FIG. 11C or FIG. 11D may be inferior to (richer than) the mode of FIG. 11A or FIG. 11B in orderliness (in randomness).

The mode in the present invention can split all the regions 3 completely with the region 4. However, as far as giving rise to the effects of the present invention, a small number of regions 3 can mutually come into contact to make a mode without sandwiching the region 4 effectively.

The diameter W of the regions 3 can be defined by the diameter of the minimum circumscribed circle at viewing the regions 3 from above (in the planar shape of the regions 3). In other words, the diameter W of each region 3 can be defined by the diameter of the minimum circumscribed circle of the region 3 present (exposed) over the surface of the electroconductive layer 2.

Material configuring the first region may be electroconductive material and can be metallic or electroconductive metal compound. For example, metal selected from the group consisting of Be, Mg, Ti, Zr, Hf, V, Nb, Ta, Mo, W, Al, Cu, Ni, Cr, Au, Pt, Pd and the like or an alloy containing those kinds of metal can be used. Material with good heat resistance property selected from the group consisting of Ti, TiN, Ta, TaN, AlN and TiAlN can be used in particular.

Height (thickness) d of the region 3 is practically selected within the range of not less than 10 nm and not more than 10 μm and can be selected within the range of not less than 10 nm and not more than 1 μm. Diameter W of the region 3 is practically selected within the range of not less than 1 nm and not more than 100 nm and can be selected within the range of not less than 1 nm and not more than 10 nm. The above described height d of the region 3 can be restated to be length in the longitudinal direction of the columnar region 3 in the case where the region 3 is shaped columnar. Otherwise the height can be restated to be distance between the two end portions in the longitudinal direction of the columnar region 3. One of the two end portions described here is an end portion in contact with the electron emission layer 5 and the other is an end portion in contact with the substrate 1 (or the third region 101).

The region 4 arranged between the adjacent two regions 3 is inferior to the region 3 in electroconductive property.

In addition, the proportion ($\rho_4/\rho_3$) of specific resistance (resistivity) $\rho_4$ of the second region 4 to specific resistance (resistivity) $\rho_3$ of the first region 3 can be as large as possible for expanding the effects of the present invention. The practical range of $\rho_4/\rho_3$ is at least not less than $10^4$, preferably not less than $10^6$ and more preferably not less than $10^8$.

In order to obtain a current limiting effect, practically the specific resistance $\rho_4$ can be not less than $10^8$ Ω·cm and practically can be not less than $10^8$ Ω·cm and not more than $10^{12}$ Ω·cm. On the other hand the specific resistance $\rho_3$ of the region 3 can be not less than $10^{-6}$ Ω·cm and practically can be not less than $10^{-6}$ Ω·cm and not more than $10^4$ Ω·cm. In the present invention, the region 4 of not less than $10^8$ Ω·cm can be restated to be an insulator.

Material configuring the region 4 can be selected for use from the group consisting of oxide, nitride and oxynitride (including the mixture of an oxide and nitride). More specifically, the material can be an insulator selected from the group consisting of oxidized titanium, the mixture of oxidized titanium and titanium nitride, oxide silicon (typically silica), silicon nitride and alumina and the like. In addition, an oxide is more preferable. As an oxide, a metal oxide or a semiconductive oxide can be used. In particular, an oxide of material configuring the region 3 is particularly simple and preferable. More preferably, the surface of the region 3 is oxidized to configure the region 4.

Here, the region 3 is configured with titanium nitride. In the case of forming the region 4 by oxidizing the surface of the region 3, the region 4 at least contains oxidized titanium and further contains titanium nitride occasionally. With the fabrication method described in the embodiment 1, for example, to be described later, a columnar region 3 can be simply formed. However, considering thermal stability at the time of driving the electron-emitting device, the region 4 can be configured by the mixture of oxidized titanium and titanium nitride.

The region 4 is arranged between the mutually adjacent regions 3. Thereby the electroconductive layer 2 is substantially divided by a number of electroconductive layers 3 (divided by diameter size of the region 3). Therefore, it is possible to limit the electroconductive path in the direction to the film thickness of the electroconductive layer 2 (in the direction where the electroconductive layer 2 and the electron emission layer 3 are stacked) to the size W of the region 3. That is, it is possible to limit the current amount traveling through the cathode electroconductive layer 2 to reach the electron emission layer 5. Therefore the resistant layer to limit the current does not have to be provided separately. Nevertheless the fluctuation of the electron emission amount from the electron emission layer 5 can be made small.

Here, the technique of actually measuring resistivity $\rho_3$ of the region 3 and resistivity $\rho_4$ of the region 4 will not be limited in particular but various techniques can be used. For example, the electroconductive layer 2 of the present invention is arranged at first over a metal film. As the region 3 (the region 4) is undergoing scanning with a probe of a scanning tunnel microscope (STM), voltage is applied to the fissure between the metal film and the probe. That enables use of a method of measuring the current flowing in the region 3 (the region 4) to measure $\rho_3$ ($\rho_4$).

The electron emission layer 5 of the present invention can be configured so as to include carbon as a main ingredient (base material or dominant component) due to good performance and stability of the electron emission property. In particular, the main ingredient of the electron emission layer 5 can be selected from the group consisting of diamond, diamond-like carbon (DLC) and amorphous carbon. However, the main ingredient of the electron emission layer 5 has high resistivity and can function substantially as an insulator. Therefore, as the main composition of the electron emission layer 3, diamond-like carbon or amorphous carbon can be used. Practically, the main ingredient of the electron emission layer 5 can have resistivity of not less than $1\times10^8$ and not more than $1\times10^{14}$ Ω·cm. In addition, the details will be described below but the electron emission layer 5 of the present invention may be a mode containing metal. Here, the resistivity of the entire electron emission layer 3 can be not less than $10^0$Ω·cm.

The electron emission layer 5 need not necessarily be a film of good conductor such as a metal film. The reason thereof is that electrons that move within a limited range inside each electroconductive path (each region 3) will spread in the electron emission layer 5 to increase the fluctuation of the emission current in the case where the electron emission layer 5 is a good conductor.

On the other hand, it is necessary to consider film thickness d' of the electron emission layer 5 in the case where resistivity $\rho_5$ of electron emission layer 5 (which can be restated substantially to be specific resistance of the main composition of the electron emission layer 5) is large. The reason thereof is that large film thickness d' of the electron emission layer 5 with high resistance makes it difficult to cause the electron-emitting (region) site deemed to be present on the surface or in the vicinity of the surface of the electron emission layer 5 to emit a sufficient amount of electrons with low drive voltage.

For the present invention, spread of electrons in the electron emission layer 5 having flown from each respective first region 3 can be controlled not to be effectively superimposed onto spread of electrons in the electron emission layer 5 having flown from its adjacent first regions 3. Such a setting enables each region 3 to emit electrons stably from immediately thereabove. For example, in the case where the region 3 is shaped columnar as in FIG. 1, the mobility range of current (electrons) flowing in a plurality of electroconductive paths (columnar regions 3) is limited to width W of the columnar region 3. Consequently, the current (electrons) in the limited electron flowing direction can be caused to directly reach an electron emission site inside the electron emission layer 5 located immediately above each columnar region 3, resulting in decrease in fluctuation of the electron emission amount.

The traveling direction in the electron emission layer 5 of electrons flowing from the electroconductive layer 2 to the electron emission layer 5 is influenced by the direction of the lines of electric force in the electron emission layer 5. The electroconductive layer 2 and the electron emission layer 5 are configured by basically different material. Therefore, curving in the lines of electric force occurs on the boundary between the electroconductive layer 2 and the electron emission layer 5 due to dielectric constants (that is, resistivity) of the respective material. When lines of electric force curve, electrons get (spread) out of the direction where the electroconductive layer 2 and the electron emission layer 5 are stacked ("direction perpendicular to the interface between the electroconductive layer 2 and the electron emission layer 5" or "direction of film thickness of the electron emission layer 5") to go toward the surface of the electron emission layer 5.

Therefore, in stabilizing (restraining fluctuation) of emission current, it is important to restrain a portion of electrons flowing from a certain region 3 in a plurality of regions 3 to the electron emission layer 5 and a portion of electrons flowing from the adjacent region 3 to the electron emission layer 5, from being emitted from the same electron emission site. In other words, in stabilizing (restraining fluctuation) of emission current, it is important to restrain electrons supplied from a plurality of regions 3 from being emitted from a single electron emission site.

With resistivity $\rho_3$ of the region 3, resistivity $\rho_4$ of the region 4, resistivity $\rho_5$ of the electron emission layer 5 and film thickness d' of the electron emission layer 5, spread in the electron emission layer 5 of electrons flowing from the regions 3 into the electron emission layer 5 can be derived.

When spread of electrons in the electron emission layer 5 becomes larger than (w'−w)/2, the range where electrons flowing from a certain region 3 spread will be superimposed onto the range where electrons flowing from the adjacent region 3 spread. Therefore, it is most important to design W'−W so as to give rise to effects of decreasing fluctuation of electron emission amount. When spread of electrons becomes larger than (w'−w)/2, the range where electrons flowing from a certain region 3 spread will be superimposed onto the range where electrons flowing from the adjacent region 3 spread, resulting in reduction in the effect of decreasing fluctuation of the electron emission amount. Therefore, it is necessary to control combination of film thickness d' of the electron emission layer 5, resistivity $p_5$ of the electron emission layer 5, resistivity $\rho_3$ of the region 3, resistivity $\rho_4$ of the region 4 and distance (w'−w) so that an effect of restraining fluctuation of the electron emission amount is attainable.

That is, in the present invention, the film thickness d' can be selected so as to restrain an occurrence that the range where electrons flowing from a region 3 to the electron emission layer 5 spread in the electron emission layer 5 is superimposed onto the range where electrons flowing from the adjacent region 3 to the electron emission layer 5 spread in the electron emission layer 5.

Therefore, the film thickness d' of the electron emission layer 5 can be selected so as to fulfill the following formula (1).

$$d' \leq \frac{1}{k}\frac{\rho_3^2}{\rho_3\rho_4}\frac{w'-w}{2} \qquad \text{(Formula 1)}$$

There, k is a constant defined according to the level of allowance on superimposition of the range where electrons flowing from a certain region 3 to the electron emission layer 5 spread in the electron emission layer 5 and the range where electrons flowing from the adjacent region 3 to the electron emission layer 5 spread in the electron emission layer 5.

Here, density of current (current density) flowing in the electron emission layer 5 immediately above the interface between the region 3 and the region 4 along the interface between the region 3 and the region 4 in the direction of thickness of the electron emission layer 5 is $I_0$. In that case, the constant k varies based on to the percentage of $I_0$ being the density of current allowed to flow to the direction of the thickness thereof in the electron emission layer 5 located immediately above the site over the region 4 apart from the interface between the region 3 and the region 4 by (W'−W)/2. Specifically, for example, the case where the density of current flowing to the direction of the thickness in the electron emission layer 5 located immediately above the region 4 apart from the interface between the region 3 and the region 4 by (W'−W)/2 is allowed up to 50% of $I_0$ will give k=1.0. If the allowed current density is low, the value of k will get further larger.

As a practical range, up to 50% of $I_0$ is allowable and, therefore, the value of k can be not less than 1.0.

Here, film thickness d' of the electron emission layer 5 is specifically selected in the range, practically, not less than 1 nm and not more than 1 μm; preferably from 1 nm and not more than 100 nm; and, preferably in particular, not less than 5 nm and not more than 20 nm. Therefore, the left-hand side of the formula (1) is substantially selected from the value of not less than 1 nm and not more than 1 μm. Matching that value, the values of $\rho_3$, $\rho_5$ and $\rho_4$ on the right-hand side are selected.

In the present invention, the electron emission layer 5 is arranged so as to span a plurality of regions 3. In the modes illustrated in FIGS. 2A and 2B and FIGS. 7A to 7C, a single electron emission layer 5 is arranged inside a single opening 21. The electron emission layer 5 covers a plurality of regions 3 located inside the single opening 21. Those modes are preferable for reducing dispersion in the electron emission amount and in the intensity of electron beam.

In the case where a plurality of electron emission layers 5 are arranged in a mutually separated fashion, electric field will tend to be concentrated into the end portions of the respective electron emission layers. Therefore, it will become difficult to emit electrons highly uniformly from a wider region in the electron emission layer. Therefore, for the electron-emitting device of the present invention, it is desirable that the electron emission layer 5 configuring a single electron-emitting device is not divided into pieces, but is an integrated single film. That is, the electron emission layer 5 can be provided so as to span a plurality of regions 3 configuring the electron-emitting device.

Here, single electron emission layer is arranged inside a single opening 21. However, the electron emission layer 5 does not necessarily have to cover all the regions 3 located inside a single opening 21. That is, there also is possible a mode for arranging the electron emission layer 5 in a portion inside the opening 21 and exposing a portion of a plurality of regions 3 in the remaining portion. However, ideally, a configuration such that all of the regions 3 inside the opening 21 are covered with the electron emission layer 5 as illustrated in FIG. 7B and FIG. 7C. In other words, the mode of exposing no electroconductive layer 2 inside the opening 21 is preferable.

Presence of electron emission layer 5 of the present invention is mainly limited to from the semiconductor region to the semiconductor side of the insulator region. Specifically, the resistivity $\rho_5$ of the electron emission layer 5 can be not less than $10^0$ Ω·cm and not more than $10^{10}$ Ω·cm, practically can be not less than $10^2$ Ω·cm and not more than $10^5$ Ω·cm. Therefore, the first region 3, the second region 4 and the electron emission layer 5 can fulfill the relation of $\rho_3<\rho_5<\rho_4$.

The technique of measuring resistivity $\rho_5$ of the electron emission layer 5 will not be limited in particular. For example, disposing electroconductive members over and under the electron emission layer 5, voltage (voltage lower than the drive voltage) of not less than 1 V and not more than 10 V is applied between the upper and lower electroconductive members. Then current flows and enables calculation.

In addition, the electron emission layer 5 of the present invention can contain metal as described above. In particular, such a mode provided with a great number of particles 6 containing metal is preferable in obtaining good electron-emitting property. Material of the particles 6 containing metal will not be limited in particular if they are electroconductive. For example, the particles 6 can be configured by metal particles or electroconductive alloy particles.

In the case where the electron emission layer 5 contains metal, resistivity of the main composition (except metal) of the electron emission layer 5 is set to larger than resistivity of the metal to be contained. Setting resistivity of the main composition of the electron emission layer 5 to not less than 100 times larger than the resistivity of the contained metal (or particles) enables electron emission with a lower electric field. The main composition of the electron emission layer 5 containing metal can be carbon and, in particular, can be diamond-like carbon or amorphous carbon.

The particle size (diameter) of a particle 6 containing metal is set smaller than the film thickness d' of the electron emission layer 5. The particles 6 can be arranged so as to form a line with at least two or more units in the direction of film thickness of the electron emission layer 5 in order to concentrate the electric field into the particles 6 as well. Therefore, the particle size (diameter) of the particles 6 can be not more than a quarter of the film thickness d' of the electron emission layer 5. The lower limit can be not less than 1 nm due to controllable nature of the particles 6 on particle size. In addition, as to at least two particles 6 forming a line in the direction of film thickness of the electron emission layer 5, distance can be set to not more than 5 nm also in order to supply electrons well. In addition, at least two particles 6 forming a line in the direction of film thickness of the electron emission layer 5 may contact each other. If the particles 6 occasionally contact each other but only in the small contact area and are located apart within a range of not more than 5 nm, exchange of electrons is feasible. Therefore an effect of restraining variation of electron emission current is considered to be attainable. Adopting such a structure, it is assumed that the electric field is concentrated onto electroconductive particles present inside the electron emission layer 5 and electrons are emitted from the electron emission layer 5.

As described above, the electron emission layer 5 is required to have high resistance. Therefore, practically the percentage of metal occupying the entire electron emission layer 5 can be not less than 10 atm % and not more than 30 atm %.

Desirable material for the insulating layer 7 can be highly pressure-resisting material capable of enduring high electric field selected from the group consisting of oxide silicon (typically silica), silicon nitride, alumina, CaF, undoped diamond and the like. Thickness of the insulating layer 7 is practically set to the range of not less than 10 nm and not more than 100 μm and can be selected from the range of not less than 100 nm and not more than 10 μm.

A second electrode 8 is selected from electroconductive material and for example, metal selected from the group consisting of Be, Mg, Ti, Zr, Hf, V, Nb, Ta, Mo, W, Al, Cu, Ni, Cr, Au, Pt, Pd and the like or an alloy containing those kinds of metal can be used. In addition, thickness thereof is practically set within the range of not less than 10 nm and not more than 10 μm and can be selected within the range of not less than 10 nm and not more than 1 μn. The same material as the material of the above described third region 101 can be used for the second electrode 8.

In addition, as illustrated in FIG. 1, FIGS. 2A and 2B and FIG. 9, in the case where a third region 101 is provided between the substrate 1 and the columnar structure 100, that material can have a high electroconductive property, like the second electrode 8. In addition, as material used for that third region 101, the same material for the above described second electrode 8 can be used.

The substrate 1 is structure provided in a substrate or over the surface of a substrate. The substrate 1 can be a substantial insulator. For the substrate 1, there usable is material selected from the group consisting of silica glass, glass with reduced content of impurities such as Na and soda lime glass. In addition, there also usable for the substrate 1 are a stacked member with oxide silicon (typically silica) being stacked over a silicon substrate and the like by the sputtering method and the like, insulating substrate of ceramics such as alumina and the like.

The size of the opening 21 is selected from the range of not less than 10 nm and not more than 50 μm and can be selected from the range of not less than 100 nm and not more than 5 μm. In addition, the opening 21 may be shaped circular or may be shaped polygonal such as quadrilateral and will not be limited in particular.

Next, an example of a process of fabricating an electron-emitting device of the present invention described above will be described below. However, the present invention will not be limited in particular to that fabrication method.

With reference to FIGS. 3A to 3H, a method of fabricating an electron-emitting device comprising a first electroconductive layer 2 related to an embodiment of the present invention and an electron emission layer 5 arranged over the first electroconductive layer 2 will be described.

(Process a)

Figure 3A:
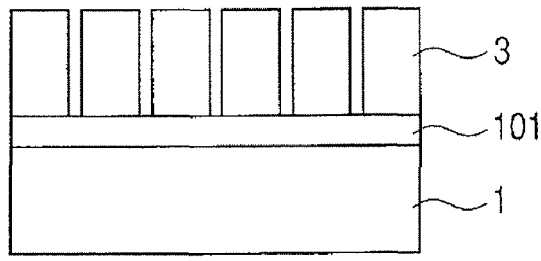
FIGS. 3A, 3B, 3C, 3D, 3E, 3F, 3G and 3H illustrate schematically an example of a method of fabricating an electron-emitting device of the present invention.

A third region 101 and a great number of columnar regions 3 are provided in advance over a substrate 1 with its surface having undergone sufficient cleaning (FIG. 3A).

As a method of forming a great number of columnar regions 3, it is possible to adopt a method of controlling the film forming condition for TiN as will be described in examples to be described below.

(Process b)

Figure 3B:
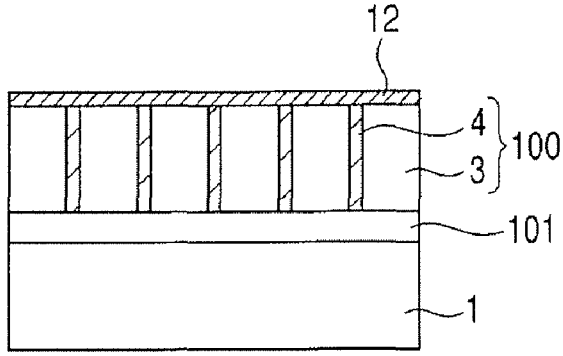
Figure 3C:
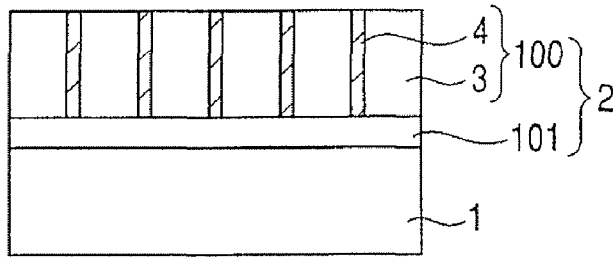
Figure 3D:
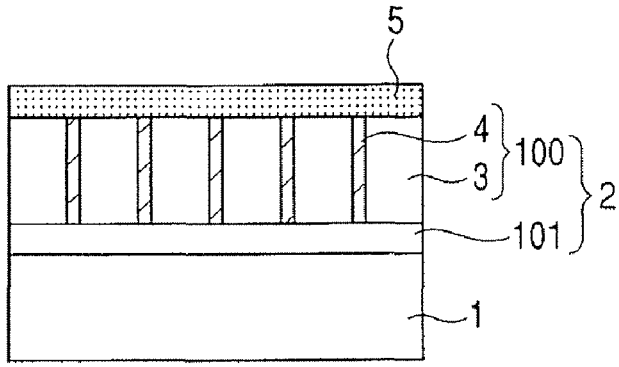

Next, a region 4 inferior to the columnar region 3 in the electroconductive property is provided in the respective fissures between a plurality of columnar regions 3 (FIG. 3B and 3C).

The region 4 can be formed, for example, by heating the columnar regions 3 in an atmosphere containing oxygen. However, the method of forming the region 4 will not be limited to the method hereof.

The region 4 formed by the above described technique contains oxide of the columnar regions 3. At the time of heating, the surface of the columnar regions 3 (the surface of the end portion opposite to the substrate 1 in the two end portions in the longitudinal direction of a columnar region 3) will be oxidized as well so that an oxidized layer 12 is occasionally formed. As for the method of heating, the substrate 1 may be arranged inside a baking furnace to heat the substrate in its entirety with a heater or a lamp and the like. Otherwise, such a method of heating only the target site with laser and the like is also possible. In addition, the atmosphere at the time of heating may be an ozone atmosphere besides the atmosphere containing oxygen. In general, any atmosphere oxidizing metal is possible. As for the level of oxidization, the level of forming thickness of the formed oxidized layer 12 possibly falls within a range of, practically, not less than 1 nm and not more than 20 nm. Heating temperature and heating time are selected appropriately.

(Process c)

The oxidized layer 12 is removed by etching to form a second electroconductive layer 2 configured by the columnar structure 100 and the third region 101 (FIG. 3C).

At that occasion, with an electron emission layer 5 to be formed in the subsequent process and the second electroconductive layer 2 being provided with sufficient electrical connection in the direction substantially perpendicular to the surface of the substrate 1, the oxidized layer 12 may remain to a certain extent. The technique of etching may be dry etching as well as wet etching and will not be limited in particular. In addition, etching may be carried out to expose the entire surface of the second electroconductive layer 2 or may be carried out to expose a portion of the second electroconductive layer 2 with photolithography and the like. In addition, the region 4 is designed to remain in the fissure between a plurality of mutually adjacent columnar regions 3.

Here, as the procedure of forming the columnar structure 100, the order from the process of forming the columnar regions 3 to the process of forming the region 4 has been described. However, for the method of fabricating the electron-emitting device of the present invention, any of that order may come first or the forming processes may take place simultaneously. For example, at first, known alumina nanoholes (corresponding to the above described region 4) are formed over the third region 101. The alumina nanoholes can be formed by anodizing the aluminum film to provide alumina film provided with a great number of columnar openings with nanosize diameters. For alumina nanoholes, a great number of columnar openings can be orientated substantially in a single direction. For example, as illustrated in FIGS. 11A and 11B, nanosized openings (corresponding to the regions illustrated with the symbol 3 in FIGS. 11A to 11D) can be easily formed to shape a matrix or a honeycomb. By implanting electroconductive material configuring the above described columnar regions 3 into each nanohole, for example, with a plating method, the columnar structure illustrated in FIG. 3C and the like can be formed.

(Process d)

Figure 3E:
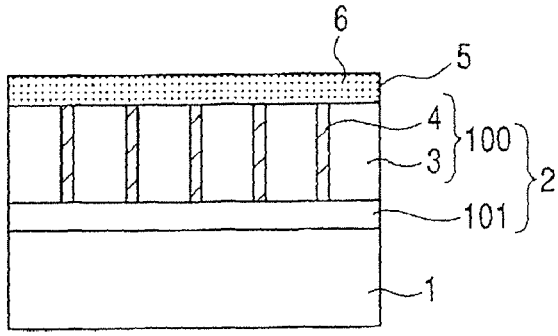

Subsequently, the electron emission layer 5 is formed over the electroconductive layer 2 (FIG. 3E).

The electron emission layer 5 can be formed with film forming technology selected from the group consisting of vapor deposition method, sputtering method, HFCVD (Hot Filament CVD method) and the like. However, the fabrication method thereof will not be limited in particular.

As the main composition of the electron emission layer 5, carbon can be preferably used. In the case of using an electron emission layer containing metal as the electron emission layer 5, there adoptable is a method of forming carbon film containing metal with multitarget in use of graphite target and metal target, for example, in the Rf sputtering method. In addition, it is also possible to use appropriately a method of controlling the amount of metal content with a single mixed target of graphite and metal. Otherwise, in the case of using diamond-like carbon as the main composition of the electron emission layer 5, the DLC film to become the main composition of the electron emission layer 5 is formed at first with the HFCVD method. Thereafter, there adoptable is a method of causing the diamond-like carbon film to contain metal with the ion injection method and the like. That is, separating metal and film to become the main composition of the electron emission layer 5, the electron emission layer 5 containing metal can be formed.

Here, as described above, the electron emission layer 5 of the present invention occasionally contains electroconductive particles 6 containing metal. For the fabrication method at that occasion, the following (process e), for example, is added.

(Process e)

In the case of forming the electron emission layer 5 including particles 6 containing metal therein, the above described (process d) is followed by heat treating so as to cause metal present in the electron emission layer 5 to agglutinate to form a plurality of particles 6.

The process hereof may not be carried out at this stage but be carried out in the following processes. The heating temperature is appropriately selected from the range of not less than 400° C. and not more than 800° C. Heating temperature and a heating rate up to the heating temperature, retaining time under the heating temperature and temperature drop rate for cooling after heating are appropriately determined by combination of metal to be used and material of the main composition of the electron emission layer 5.

(Process f)

After implementing at least the above described voltage was Va=10 kV and Vb=20 V. Distance H between the electron emission layer 3 and the anode electrode 8 was 2 mm.

Consequently, the electron-emitting device was not delaminated from the substrate 1 but a stable electron-emitting property was presented and moreover, likewise in the example 1, it was possible to form the electron-emitting device with less fluctuation in the electron emission amount.

Example 3

Figure 5:
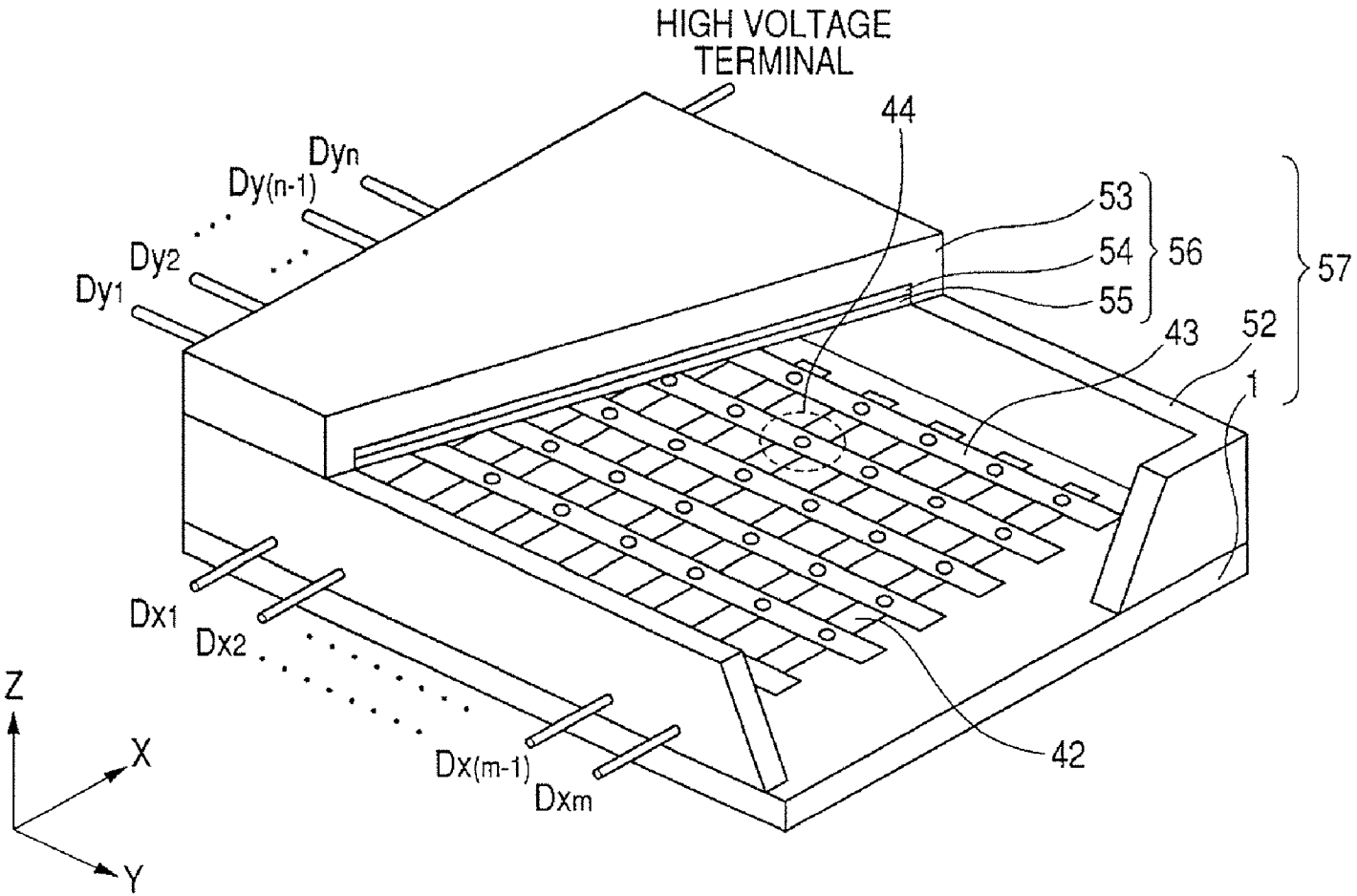
FIG. 5 illustrates schematically an example of an image display apparatus with an electron-emitting device of the present invention.

With the electron-emitting device produced in the above described example 2, an electron-emitting device 57 illustrated in FIG. 5 was produced.

Figure 3F:
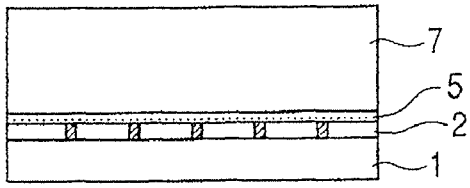
Figure 3G:
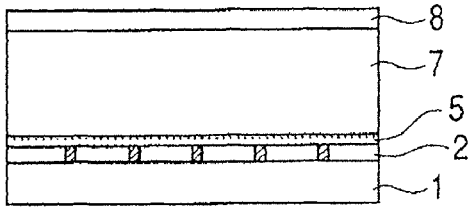

One hundred each of the electron-emitting devices illustrated in the example 2 were arranged in the X direction and in the Y direction to shape a matrix. As to wiring, the X direction wiring 42 ($Dx_1$ to $Dx_m$) was connected to the electroconductive layer 2 and the Y direction wiring 43 ($Dy_1$ to $Dy_n$) was connected to the gate electrode 8 as illustrated in FIG. 5. A phosphor layer 54 and metal back 55 being an anode electrode were arranged above the respective electron-emitting devices 44. FIG. 5 illustrates an example where a single opening 21 is formed in a single electron-emitting device 44. However, the number of the openings will not be limited to one, but a plurality of openings may be provided. processes (a) to (d), the insulating layer 7 is deposited over the electron emission layer 5 (FIG. 3F).

The insulating layer 7 may be formed with a general vacuum technology selected from the group consisting of sputtering method, a CVD method, a vacuum vapor deposition method and the like and may be formed with print processes and the like but will not be limited in particular.

(Process g)

An electroconductive layer 8 to finally become the second electrode (gate electrode) is arranged over the insulating layer 7.

The electroconductive layer 8 may be formed with a method selected from the group consisting of a vapor deposition method, general film forming technology such as a sputtering method, a photolithography technology, and may be formed with print processes and the like but will not be limited in particular.

(Process h)

There formed on the electroconductive layer 8 is a mask (not illustrated in the drawing) including a pattern (opening) for forming an opening 21 piercing the above described electroconductive layer 8 and the insulating layer 7 with a photolithography technology and the like.

Figure 3H:
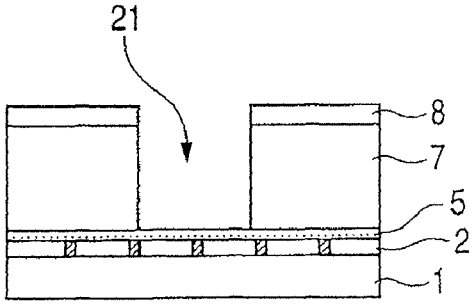

And, with the above described mask, an etching process is carried out to form the opening 21 piercing the electroconductive layer 8 and the insulating layer 7 to reach the upper surface of the electron emission layer 5. Thereafter, a mask pattern is removed (FIG. 3H).

Here, the etching technique will not be limited and the planar shape of the opening 21 will not be limited to the circular shape.

(Process i)

After finishing the above described processes (a) to (h), a process of finishing the surface of the electron emission layer 5 with hydrogen can be provided in order to further improve the electron-emitting property of the electron-emitting device of the present invention. Finishing the surface of the electron emission layer 5 with hydrogen can further simplify emission of electrons.

With the above described processes, the electron-emitting device of the present invention can be formed. According to the above described fabrication method, providing the regions 4 between the regions 3, it is possible to restrain the spread of the metal present in the electron emission layer 5 through a plurality of regions 3. As a result, dispersion in the amount of metal content in the electron emission layer during the processes can be restrained so that an electron emission layer with high reproducibility and predetermined properties can be formed. That is, in the case where the process of heating the electron emission layer 5 containing metal (for example, the heating process of the above described process (e)) is required, dispersion in the amount of metal content in the electron emission layer can be restrained. In particular, as in examples to be described below, it is known that metal contained in the electron emission layer 5 is mobile by heating without difficulty between the columnar regions 3 of titanium nitride. Therefore, carrying out the heating process after arranging oxidized titanium (occasionally nitrogen is contained) between the columnar regions 3, the above described dispersion can be preferably restrained. In addition, by configuring the electroconductive layer 2 with a great number of regions 3, it is possible to reduce such a problem that the electron emission layer 5 (in particular a layer including carbon as the main ingredient) is delaminated from the electroconductive layer 2 due to heat generation in the heating process at the time of fabrication and at the time of driving.

Next, an application example of the electron-emitting device of the present invention will be described below.

By arranging a plurality of electron-emitting devices of the present invention over the surface of the same substrate, it is possible, for example, to configure an electron source and an image display apparatus.

Figure 4:
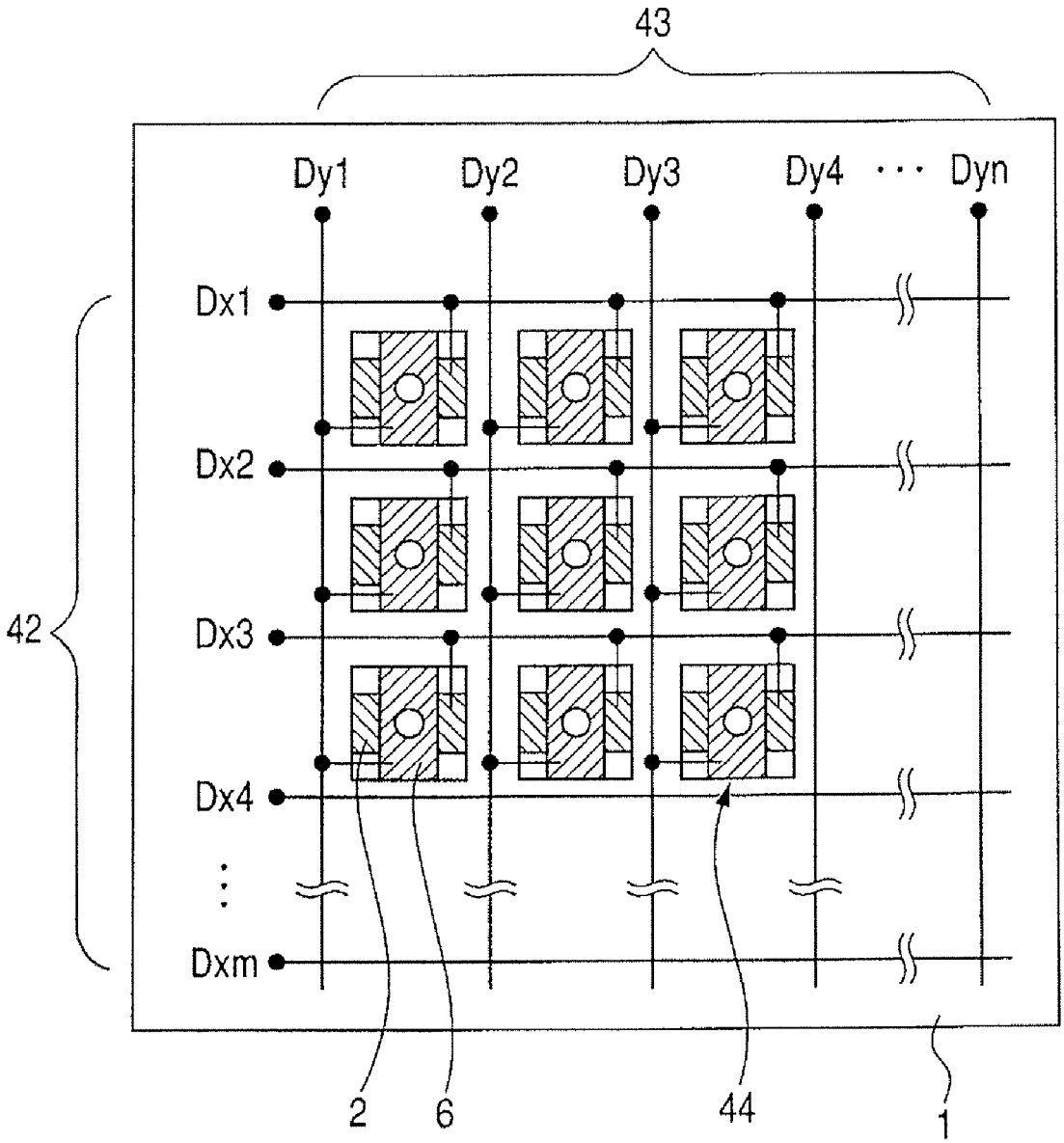
FIG. 4 illustrates schematically an example of an electron source with an electron-emitting device of the present invention.

With reference to FIG. 4, an electron source obtained by arranging a plurality of electron-emitting devices of the present invention will be described. FIG. 4 includes a substrate 1, X direction wiring 42, Y direction wiring 43 and an electron-emitting device 44 of the present invention.

X direction wiring 42 is configured by m units of wiring $Dx_1$, $Dx_2$, through to $Dx_m$ and can be configured by electroconductive material (typically, metal) with a method selected from the group consisting of a vacuum vapor deposition method, print processes, a sputtering method and the like. Material, film thickness and width of wiring are appropriately designed. Y direction wiring 43 is configured by n units of wiring $Dy_1$, $Dy_2$, through to $Dy_n$ and can be formed like the X direction wiring 42. An inter-layer insulating layer not illustrated in the drawing is provided between these m units of X direction wiring 42 and n units of Y direction wiring 43 to electrically separate the both. Here, m and n are both positive integers. The inter-layer insulating layer not illustrated in the drawing is configured by silicon oxide and the like formed with a method selected from the group consisting of a vacuum vapor deposition method, print processes, a sputtering method and the like.

The first electrode (cathode electrode) 2 configuring the electron-emitting device 44 is electrically connected to one of the m units of the X direction wiring 42 and the second electrode (gate electrode) 8 is electrically connected to one of the n units of the Y direction wiring 43.

Material configuring the X direction wiring 42, the Y direction wiring 43, the first electrode and the second electrode may be the same in a part of the component element or in their entirety and may be different each other. In the case where material configuring the first and second electrodes and material for wiring are the same, it is comprehensible that the X direction wiring 42 and the Y direction wiring 43 are the first electrode and the second electrode respectively.

A scan signal applying unit not illustrated in the drawing for applying a scan signal in order to select the row of the electron-emitting device 44 arranged in the X direction is connected to the X direction wiring 42. On the other hand, a modulation signal generating unit not illustrated in the drawing for applying the modulation signal to each column of the electron-emitting devices 44 arranged in the Y direction is connected to the Y direction wiring 43. The drive voltage applied to each electron-emitting device is defined as a balance voltage between the scan signal and the modulation signal applied to the relevant device.

The above described configuration selects individual electron-emitting device and can cause it to operate independently. An image display apparatus configured by such an electron source with a matrix arrangement will be described with FIG. 5. FIG. 5 schematically illustrates an example of a display panel 57 configuring an image display apparatus.

FIG. 5 includes a substrate (occasionally called "rear plate") 1 comprising an electron source. There included is a face plate provided with a transparent substrate 53, a light-emitting structure layer 54 made of light-emitting structure emitted by irradiation of electron beam such as phosphor arranged on the inner surface of the transparent substrate 53 and electroconductive film (occasionally called metal back) 55 as an anode electrode. There included is a support frame 52. The rear plate 1 and the face plate 56 are connected (sealed) to the support frame 52 with adhesive such as frit glass. There illustrated is an envelope (hermetically sealed container) 57, which is configured by bringing the face plate, the rear plate and the support frame into seal bonding. A support member called spacer not illustrated in the drawing can be installed between the face plate 56 and the rear plate 1 to configure the envelope 57 provided with sufficient strength against the atmosphere pressure.

In addition, with the envelope (display panel) (57) of the present invention described with FIG. 5, the information display and reproducing apparatus can be configured.

Specifically, a signal included in the signal tuned by a receiver and a tuner for tuning the received signals is output to the display panel 57 and is caused to be displayed or reproduced on a screen of the display panel 57. The above described receiver can receive broadcast signals of television broadcast and the like. In addition, the signal included in the above described tuned signals is designated to be at least one of video information, text information and audio information. Here, it is comprehensible that the above described "screen" corresponds to light-emitting structure layer 54 in the display panel 57 illustrated in FIG. 5. This configuration can configure information display and reproducing apparatus such as a television. Of course, in the case where the broadcast signals are encoded, the information display and reproducing apparatus of the present invention can also include a decoder. In addition, audio signals are output to an audio reproducing unit such as a separately provided speaker and the like and are reproduced in synchronization with video information and text information displayed on the display panel 57.

In addition, a method of outputting video information or text information onto the display panel 57 to display and/or reproduce it can be carried out as follows, for example. First, image signals corresponding with respective pixels of the display panel 57 are generated based on the video information and text information received. And the generated image signals are input to a drive circuit (C12) of the display panel C11. And, a voltage applied from the drive circuit to each electron-emitting device inside the display panel 57 is controlled based on the image signals input to the drive circuit and thereby images are displayed.

Figure 12:
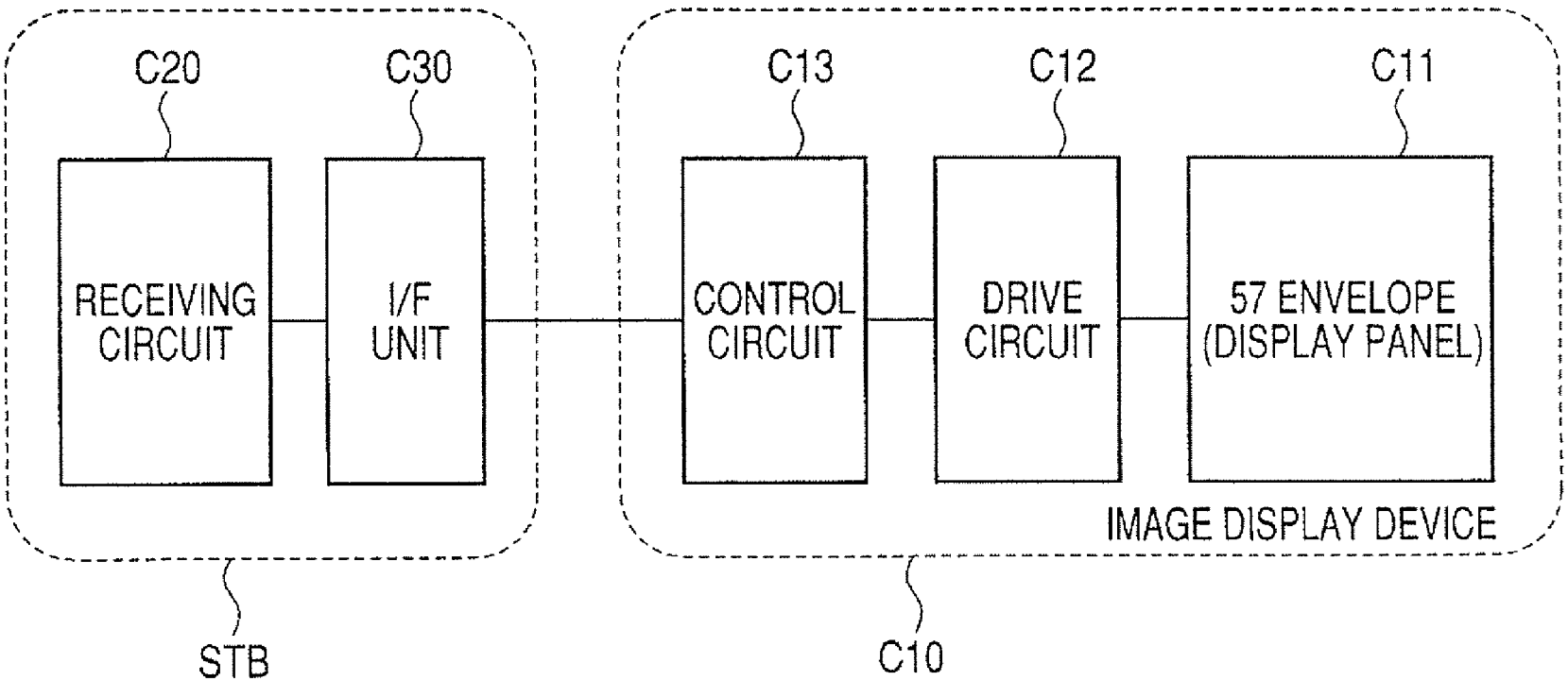
FIG. 12 is a block diagram of an example of an information display and reproducing apparatus of the present invention.

FIG. 12 is a block diagram of a television apparatus being an example of the information display and reproducing apparatus of the present invention. The receiving circuit C20 is configured by a tuner, a decoder and the like; receives television signals of such as satellite broadcasts, terrestrial broadcasts and the like and data broadcasts and the like through networks such as the Internet; and outputs the decoded video data to an I/F unit (interface unit) C30. The I/F unit C30 converts video data into a display format of a display apparatus to output the image data to the above described display panel C11. The image display apparatus C10 includes a display panel C11, a drive circuit C12 and a control circuit C13. The control circuit carries out image processing such as adjustment operation and the like appropriate for a display panel on the input image data and outputs the image data and respective kinds of control signals to the drive circuit C12. The drive circuit C12 outputs drive signals to each wiring (see the wiring $Dx_1$ to $Dx_m$ and the wiring $Dy_1$ to $Dy_n$ in FIG. 5) of the display panel C11 based on the input image data to display a television video. The receiving circuit C20 and the I/F unit C30 may be housed in an enclosure separate from the image display apparatus C10 as a set top box (STB) and may be housed in the same enclosure as the image display apparatus C10.

In addition, the interface can be configured connectable to an image storage apparatus and an image output storage apparatus selected from the group consisting of a printer, a digital video camera, a digital camera, a hard disc drive (HDD), a digital video disk (DVD) and the like. And, thus, the image stored in the image storage apparatus can be displayed on the display panel C11. In addition, the information display and reproducing apparatus (or television) can be configured to be capable of processing images displayed on the display panel C11 corresponding with necessity and outputting them to an image output apparatus.

The configuration of the information display and reproducing apparatus described herein is an example and various variations are feasible based on the technological ideas of the present invention. In addition, the information display and reproducing apparatus of the present invention can be connected to a teleconference system and a system such as a computer and the like to thereby configure various information display and reproducing apparatuses.

EXAMPLES

Examples of the present invention will be described in detail below.

Example 1

An electron-emitting device illustrated in FIGS. 2A and 2B are produced according to the process illustrated in FIGS. 6A to 6H.

(Process 1)

A silica substrate is used as the substrate 1, which is cleaned sufficiently. Thereafter, in order to form a great number of columnar regions 3 on the substrate 1, TiN film with a thickness of 100 nm is formed with the sputtering method under condition 1 to be described below. As for atmosphere gas for the condition 1 to be described below, gas mixed in proportion of Ar gas to $N_2$ gas being 9:1 is used.

(Condition 1)

Rf power supply: 13.56 MHz

Rf output: 8 W/cm$^2$

Atmosphere gas pressure: 1.2 Pa

Target: Ti

Figure 6A:
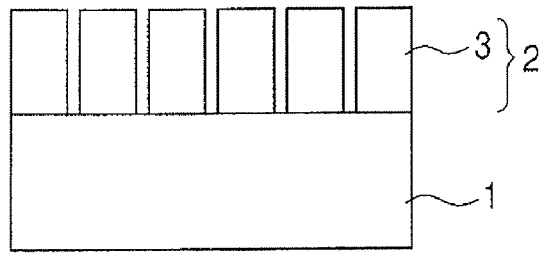
FIGS. 6A, 6B, 6C, 6D, 6E, 6F, 6G and 6H illustrate schematically an example of a method of fabricating an electron-emitting device of the present invention.
Figure 6B:
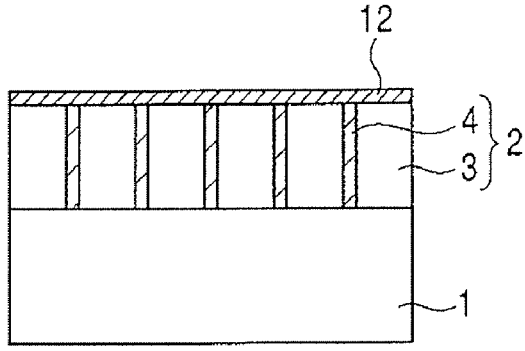

The formed TiN film was configured by a great number of columnar regions 3 as illustrated in FIG. 6A. The average diameter W of the columnar regions 3 was 30 nm and the resistivity $\rho_3$ thereof was $10^{-4}$ Ω·cm. The surface of the formed TiN film undergoes image taking at a magnification of 0.2 million times with a scanning electron microscope to measure the diameter with the photograph thereof. The average diameter W is a numeric value attained by averaging.

Here, as material capable of simply forming a great number of columnar regions 3 by controlling film forming conditions like that, material selected from the group consisting of Ti, TiN, Ta, TaN, Al, AlN, TiAlN can be nominated.

(Process 2)

Next, the substrate 1 subject to the above described process 1 was put in an oven of the air atmosphere (atmosphere containing oxygen) and underwent heating at 350° C. for an hour. Then, as in FIG. 6B, second regions 4 mainly comprising an oxide of Ti were formed between the adjacent TiN columnar regions 3 (sides of the columnar regions 3). In addition, at the same time, an oxide layer 12 of Ti was formed over the surface of the columnar regions 3.

As a result of observation with a TEM (Transmission Electron Microscope), presence of the regions 4 could be observed in the fissure between the adjacent two columnar regions 3. The regions 4 underwent qualitative analysis with an EDX (energy dispersion X-ray analyzer). Then presence of Ti, oxygen and N was admitted and the regions 4 could be confirmed to be an oxide. In addition, as a result of measuring with ESCA (X-ray photoelectron spectrometry method), presence of an oxide of Ti and a nitride of Ti was confirmed. In addition, the width W'−W of the layer 4 was 14 nm and resistivity $\rho_4$ thereof was $10^9$ Ω·cm.

(Process 3)

Figure 6C:
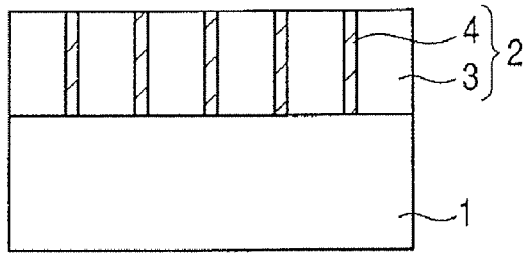

Dry etching is carried out to remove the oxidized layer 12 on the surface of the columnar regions 3 and to expose the not oxidized surface of the electroconductive layer 2 (FIG. 6C). That is, the regions 3 and the regions 4 are exposed. At that occasion, the regions 4 being oxide layers in the fissure between a plurality of adjacent columnar regions 3 of TiN was not removed but the fissure between the adjacent columnar regions 3 was left filled.

(Process 4)

Figure 6D:
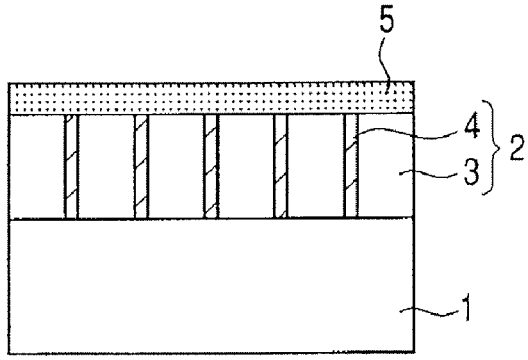

Subsequently, with sputtering method, carbon film 5 containing cobalt was deposited to attain a thickness of 12 nm over the electroconductive layer 2 (FIG. 6D).

As the main composition of the carbon film 15, amorphous carbon was used. Accordingly, the film 15 formed through that process can be restated to be film containing cobalt with amorphous carbon as the main composition. Specific resistance of that film containing cobalt was $10^3$ Ω·cm.

(Process 5)

Figure 6E:
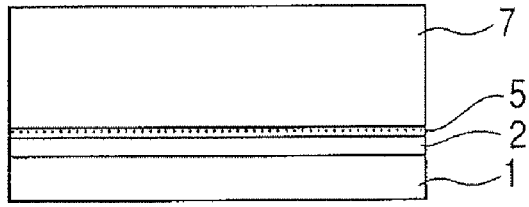

$SiO_2$ film with a thickness of 1000 nm was formed as the insulating layer 7 over the carbon film 15 with the plasma CVD method (FIG. 6E).

(Process 6)

Figure 6F:
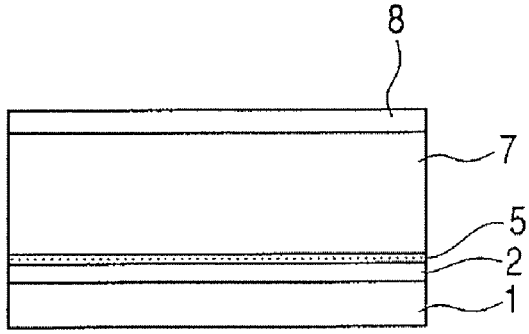

Pt film with a thickness of 100 nm was formed as the gate electrode 8 over the insulating layer 7 (FIG. 6F).

(Process 7)

Subsequently, the surface of the gate electrode 8 underwent spin-coating with positive photoresist so that the photomask pattern (in a circular shape) was exposed and developed to form a mask pattern not illustrated in the drawing. The mask pattern is provided with circular openings. The opening diameter at that occasion was set to 1.5 μm. Here, as for the number of the openings, a plurality of openings may be formed as illustrated in FIGS. 7A to 7C and will not be limited in particular.

(Process 8)

Figure 6G:
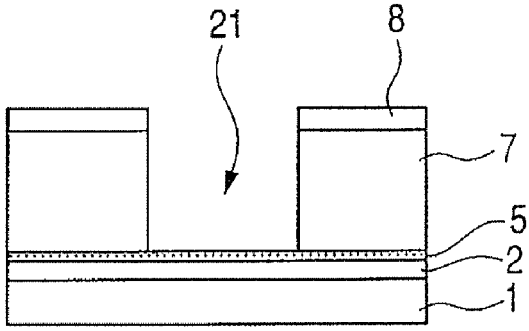

With dry etching, the gate electrode 8 and the insulating layer 7 located immediately under the opening of the above described mask pattern underwent etching until the surface of the carbon film 5 was exposed. Thereby the opening 21 was formed (FIG. 6G).

(Process 9)

The remaining mask pattern (not illustrated in the drawing) is removed with a delamination solution and was cleaned with water.

(Process 10)

Figure 6H:
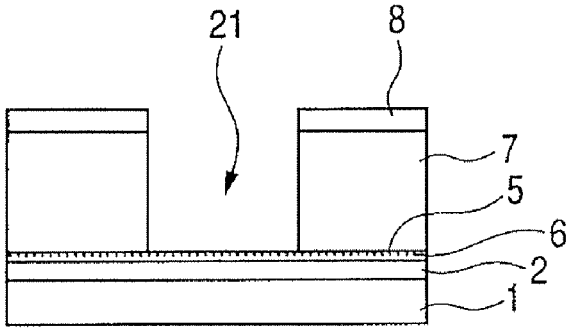

Next, the substrate 1 underwent heat treatment at 550° C. for 300 minutes in a mixed gas atmosphere containing acetylene and hydrogen. That heat treatment caused cobalt to agglutinate to form carbon film 5 (that is, electron emission layer 5) including cobalt particles 6 (FIG. 6H).

Through the above described processes, the electron-emitting device of the example 1 was completed.

Electron-emitting properties of thus produced electron-emitting device were measured. At the occasion of measurement, an anode electrode 9 was arranged above the electron-emitting device apart from the electron-emitting device produced in the present example as illustrated in FIG. 9. Potential is applied respectively to the anode electrode 9, the electroconductive layer 2 and the gate electrode 8 to measure the electron-emitting properties.

The applied voltage was Va=10 kV and Vb=20 V. Distance H between the electron emission layer 5 and the anode electrode 9 was 2 mm. Consequently, in the electron-emitting device with TiN film provided with no columnar region, a portion of the electron-emitting device was delaminated from the substrate 1. On the other hand, the electron emission layer 5 was not delaminated from the substrate 1 in the electron-emitting device of the present example, which presented a stable electron-emitting property and less fluctuation in the electron emission amount.

In addition, in order to compare fluctuation in the electron emission amount, an electron-emitting device 1 with carbon film 5 with a thickness of 20 nm formed in the above described process 4 and an electron-emitting device 2 with carbon film 5 formed to attain a thickness of 100 nm were prepared. Those electron-emitting devices 1 and 2 are formed with the method likewise the method of fabricating the electron-emitting device of the example 1 except the above described thickness.

Fluctuation in electron emission amount of the electron-emitting device of the example 1 was compared with the fluctuation in electron emission amount of the electron-emitting devices 1 and 2 into comparison. As a result of bringing the electron-emitting device of the example 1 and the electron-emitting device 1 into comparison, the electron-emitting device of the example 1 was slightly better. On the other hand, as a result of comparing the electron-emitting device 1 with the electron-emitting device 2, fluctuation in the electron emission amount of the electron-emitting device 1 was extremely smaller.

The values of respective k at that occasion were 5.0 for the electron-emitting device of the example 1, 3.5 for the electron-emitting device 1 and 0.70 for the electron-emitting device 2. That is, superimposition of spread of electrons at the electron-emitting point onto spread of electrons at its adjacent electron-emitting point took place at the site with $I_0$ being 61% in the electron-emitting device 2 and fluctuation in electron emission was large in particular.

A reason hereof is inferred that the electron-emitting device 2 does not fulfill the above described formula 1, and therefore spread of electrons flowing in from a region 3 will be substantially superimposed onto spread of electrons flowing in from the adjacent region 3. Thus, unless film thickness of the electron-emitting device 5 fulfills the formula 1, fluctuation of the electron emission amount tends to increase remarkably.

In addition, changing the conditions in the above described process 1 to conditions 2 to be described below, an electroconductive layer 2 comprising no columnar region 3 was formed. Subsequently, without carrying out the above described processes 2 and 3, the above described processes 4 to 10 were carried out to produce an electron-emitting device 3 for comparison. Here, the atmosphere gas in the condition 2 to be described below was mixed gas in proportion of Ar gas to $N_2$ gas being 9:1.

(Condition 2)

Rf power supply: 13.56 MHz

Rf output: 8 W/cm$^2$

Gas pressure: 0.4 Pa

Target: Ti

The formed TiN film under the above described condition 2 was bulk film lacking columnar regions. Fluctuation in electron emission amount of the electron-emitting device 3 for comparison was extremely large compared with the electron-emitting devices of the example 1. In addition, in the case of another sample produced in the same fabrication process, the electron emission layer was delaminated from the substrate. In addition, in the case of still another sample, the amount of metal content in the electron emission layer decreased by a large margin compared with the electron emission layer produced in the example 1. That tendency was observable also in the electron emission layer produced without carrying out the above described process 2 and process 3.

Example 2

In the present example, electron-emitting device illustrated in FIGS. 2A and 2B was produced according to the process illustrated in FIGS. 8A to 8H. Here, the electron-emitting device of the example 2 is an electron-emitting device configured by an electron emission layer 5 arranged only inside the opening 21 unlike the example 1.

(Process 1)

Figure 8A:
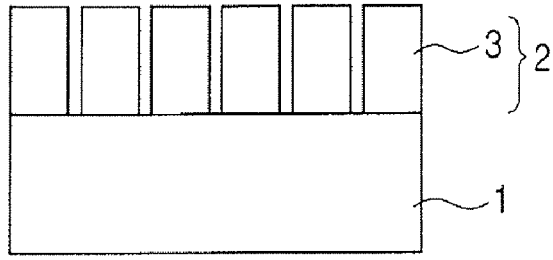
FIGS. 8A, 8B, 8C, 8D, 8E, 8F, 8G and 8H illustrate schematically an example of a method of fabricating an electron-emitting device according to the present invention.
Figure 8B:
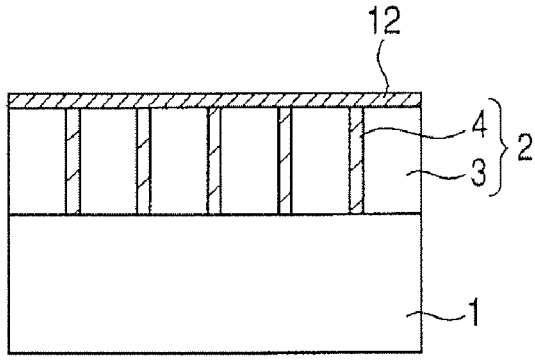

As in the process 1 of the example 1, there formed were columnar regions 3 including a great number of TiN on the substrate 1 (FIG. 8A). The average diameter of the columnar regions 3 was 30 nm. The resistivity $\rho_3$ thereof was $10^{-4}$ Ω·cm.

(Process 2)

Next, the substrate 1 was put in an ashing device of the ozone atmosphere and underwent ozone ashing. Then, second regions 4 mainly comprising an oxide of Ti were formed between a plurality of the adjacent TiN columnar regions 3 (sides of the columnar regions 3). In addition, at the same time, an oxide layer 12 was formed over the surface of the columnar regions 3.

As a result of observation with a TEM (Transmission Electron Microscope), the region 4 was observed in the fissure between the columnar regions 3 and the adjacent columnar regions 3. The regions 4 underwent qualitative analysis with an EDX (energy dispersion X-ray analyzer). Then presence of oxygen was admitted and the regions 4 could be confirmed to be an oxide. In addition, the width of the region 4 was 14 nm and resistivity thereof was $10^9$ Ω·cm.

(Process 3)

Figure 8C:
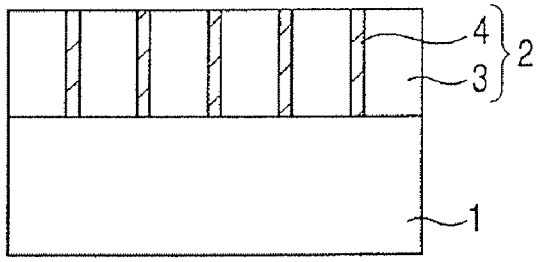

Likewise the process 3 in the example 1, dry etching is carried out to remove the oxidized layer 12 and to expose the not oxidized surface of the electroconductive layer 2 (FIG. 8C).

(Process 4)

Figure 8D:
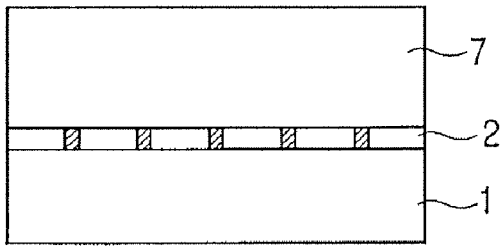

$SiO_2$ film with a thickness of 1000 nm was formed as the insulating layer 7 over the electroconductive layer 2 with the plasma CVD method (FIG. 8D).

(Process 5)

Figure 8E:
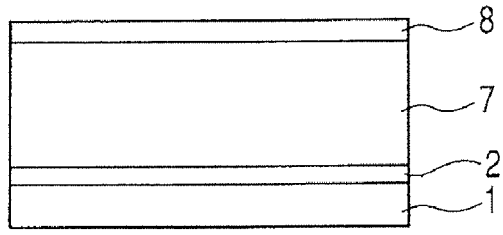

Pt film with a thickness of 100 nm was formed as the gate electrode 8 over the insulating layer 7 (FIG. 8E).

(Process 6)

Subsequently, a mask pattern not illustrated in the drawing was formed over the gate electrode 8 likewise in the process 7 in the example 1. The mask pattern was provided with circular openings and the opening diameter was set to 1.5 μm.

(Process 7)

Figure 8F:
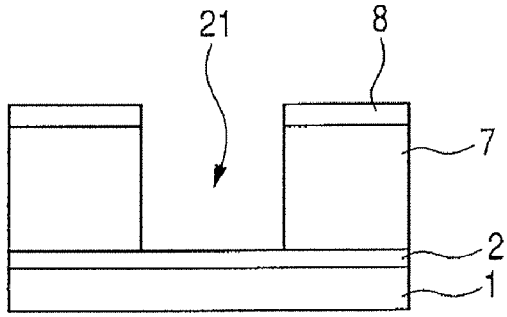

With dry etching, the gate electrode 8 and the insulating layer 7 located immediately under the opening of the above described mask pattern underwent etching until the surface of the electroconductive layer 2 was exposed. Thereby the opening 21 was formed (FIG. 8F).

(Process 8)

Figure 8G:
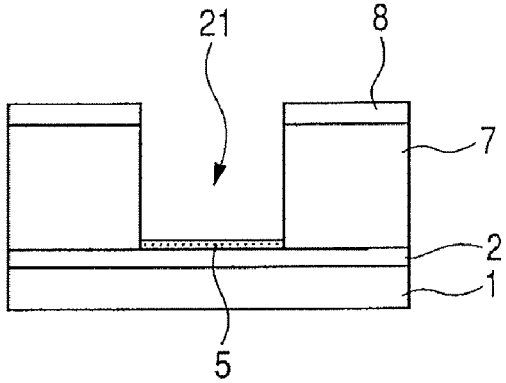

Subsequently, with sputtering method, carbon film 5 containing cobalt was deposited to attain a thickness of 12 nm over the electroconductive layer 2 exposed inside the opening 21 with the sputtering method (FIG. 8G). Specific resistance of that film 5 containing cobalt was $10^3$ Ω·cm.

(Process 9)

The remaining mask pattern (not illustrated in the drawing) was removed with a delamination solution and was cleaned with water.

(Process 10)

Figure 8H:
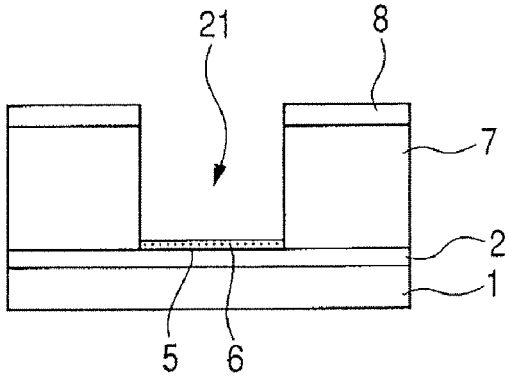

Next, carbon film 5 (that is, electron emission layer 5) including cobalt particles 6 was formed with technique likewise in the process 10 of the example 1 (FIG. 8H).

Through the above described processes, the electron-emitting device of the example 2 was completed.

In addition, an anode electrode 9 was arranged as illustrated in FIG. 10 likewise in the example 1 to measure electron-emitting properties of the electron-emitting device produced in the example 2. The applied In order to seal the envelope 57, the rear plate 1 and the face plate 56 were sealed to sandwich the support frame 52 in between with iridium as adhesive. Consequently, the image display apparatus was successfully formed to enable simple matrix drive and with high fineness and less dispersion in luminance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-117730, filed Apr. 21, 2006 which is hereby incorporated by reference herein in its entirety.

What is claimed is:

1. An electron-emitting device comprising an electroconductive layer and an electron emission layer arranged over the electroconductive layer, wherein:

the electroconductive layer has a surface including at least (A) a plurality of first regions and (B) a second region being provided between the first regions and having a resistance higher than that of the first regions, wherein said surface is located at a side of the electron emission layer, and the electron emission layer covers the surface of the electroconductive layer so that the electron emission layer continuously covers each of the plurality of first regions, wherein resistivity of a main composition of the electron emission layer is higher than resistivity of the first regions and lower than resistivity of the second region.

2. An electron-emitting device comprising an electroconductive layer and an electron emission layer arranged over the electroconductive layer, wherein:

the electroconductive layer has a surface including at least (A) a plurality of first regions and (B) a second region being provided between the first regions and having a resistance higher than that of the first regions, wherein said surface is located at a side of the electron emission layer, and the electron emission layer covers the surface of the electroconductive layer so that the electron emission layer continuously covers each of the plurality of first regions, wherein a main composition of the electron emission layer has a resistivity of not less than $1\times10^{8}$ Ω·cm and not more than $1\times10^{14}$ Ω·cm.

3. An electron-emitting device comprising an electroconductive layer and an electron emission layer arranged over the electroconductive layer, wherein:

the electroconductive layer has a surface including at least (A) a plurality of first regions and (B) a second region being provided between the first regions and having a resistance higher than that of the first regions, wherein said surface is located at a side of the electron emission layer, and the electron emission layer covers the surface of the electroconductive layer so that the electron emission layer continuously covers each of the plurality of first regions, wherein a main ingredient of the electron emission layer is carbon, wherein the electron emission layer contains a plurality of metal particles and wherein a resistivity of the main composition of the electron emission layer is not less than 100 times the resistivity of the metal particles.

4. An electron-emitting device comprising an electroconductive layer and an electron emission layer arranged over the electroconductive layer, wherein:

the electroconductive layer has a surface including at least (A) a plurality of first regions and (B) a second region being provided between the first regions and having a resistance higher than that of the first regions, wherein said surface is located at a side of the electron emission layer, and the electron emission layer covers the surface of the electroconductive layer so that the electron emission layer continuously covers each of the plurality of first regions, wherein the following formula (1) is fulfilled in the case where film thickness of the electron emission layer is d'

$$d' \leq \frac{1}{k}\frac{\rho_5^2}{\rho_3\rho_4}\frac{w^1 - w}{2} \quad (1)$$

where $W^1$-W is the length of the second region, $\rho_3$, $\rho_4$, $\rho_5$, are specific resistances of the first regions, the second region, and the electron emission layer, respectively, k is a constant not less than 1.0.

5. An electron-emitting device comprising an electroconductive layer and an electron emission layer arranged over the electroconductive layer, wherein:

the electroconductive layer has a surface including at least (A) a plurality of first regions and (B) a second region being provided between the first regions and having a resistance higher than that of the first regions, wherein said surface is located at a side of the electron emission layer, and the electron emission layer covers the surface of the electroconductive layer so that the electron emission layer continuously covers each of the plurality of first regions, wherein the first regions contain material selected from the group consisting of Ti, TiN, Ta, TaN, AlN and TiAlN.

6. An electron-emitting device comprising (A) a member comprising a plurality of first regions each of which is a columnar region and which are provided over a substrate and a second region higher than the first regions in resistance and provided between the plurality of first regions and (B) an electron emission layer provided in contact with the plurality of first regions and over the second region with higher resistance than that of the first regions so that the electron emission layer continuously covers each of the plurality of first regions, wherein resistivity of a main composition of the electron emission layer is higher than resistivity of the first regions and lower than resistivity of the second region.

7. An electron-emitting device comprising (A) a member comprising a plurality of first regions each of which is a columnar region and which are provided over a substrate and a second region higher than the first regions in resistance and provided between the plurality of first regions and (B) an electron emission layer provided in contact with the plurality of first regions and over the second region with higher resistance than that of the first regions so that the electron emission layer continuously covers each of the plurality of first regions, wherein a main composition of the electron emission layer has resistivity of not less than $1\times10^{8}$ Ω·cm and not more than $1\times10^{14}$ Ω·cm.

8. An electron-emitting device comprising (A) a member comprising a plurality of first regions each of which is a columnar region and which are provided over a substrate and a second region higher than the first regions in resistance and provided between the plurality of first regions and (B) an electron emission layer provided in contact with the plurality of first regions and over the second region with higher resistance than that of the first regions so that the electron emission layer continuously covers each of the plurality of first regions, wherein a main ingredient of the electron emission layer is carbon, wherein the electron emission layer contains a plurality of metal particles and wherein resistivity of the main composition of the electron emission layer is not less than 100 times the resistivity of the metal particles.

9. An electron-emitting device comprising (A) a member comprising a plurality of first regions each of which is a columnar region and which are provided over a substrate and a second region higher than the first regions in resistance and provided between the plurality of first regions and (B) an electron emission layer provided in contact with the plurality of first regions and over the second region with higher resistance than that of the first regions so that the electron emission layer continuously covers each of the plurality of first regions, wherein the following formula (1) is fulfilled in the case where film thickness of the electron emission layer is d'

$$d' \leq \frac{1}{k}\frac{\rho_5^2}{\rho_3\rho_4}\frac{w^1 - w}{2} \quad (1)$$

where $W^1$-W is the length of the second region, $\rho_3$, $\rho_4$, $\rho_5$, are specific resistances of the first regions, the second region, and the electron emission layer, respectively, k is a constant not less than 1.0.

10. An electron-emitting device comprising (A) a member comprising a plurality of first regions each of which is a columnar region and which are provided over a substrate and a second region higher than the first regions in resistance and provided between the plurality of first regions and (B) an electron emission layer provided in contact with the plurality of first regions and over the second region with higher resistance than that of the first regions so that the electron emission layer continuously covers each of the plurality of first regions, wherein each columnar region contains material selected from the group consisting of Ti, TiN, Ta, TaN, AlN and TiAlN.

* * * * *